US007367927B2

(12) United States Patent
Krull

(10) Patent No.: US 7,367,927 B2
(45) Date of Patent: May 6, 2008

(54) METHODS AND APPARATUS FOR SUPPORTING SELECTORIZED DUMBBELLS

(76) Inventor: Mark A. Krull, P.O. Box 7198, Bend, OR (US) 97708

( * ) Notice: Subject to any disclaimer, the term of this patent is extended or adjusted under 35 U.S.C. 154(b) by 752 days.

(21) Appl. No.: 10/633,043

(22) Filed: Aug. 1, 2003

(65) Prior Publication Data

US 2004/0023765 A1 Feb. 5, 2004

Related U.S. Application Data

(63) Continuation-in-part of application No. 10/212,833, filed on Aug. 5, 2002, now Pat. No. 7,156,782.

(51) Int. Cl.
*A63B 21/00* (2006.01)

(52) U.S. Cl. ..... 482/107; 482/108; 482/93

(58) Field of Classification Search ..... 482/104–108, 482/142, 93, 98, 109
See application file for complete search history.

(56) References Cited

U.S. PATENT DOCUMENTS

| | | | | | |
|---|---|---|---|---|---|
| 4,477,074 | A * | 10/1984 | Bushnell | 482/108 |
| 5,472,367 | A * | 12/1995 | Slocum et al. | 451/5 |
| 5,993,360 | A * | 11/1999 | Stevens | 482/104 |
| 6,905,446 | B2 * | 6/2005 | Greenland | 482/100 |
| 2001/0018387 | A1 * | 8/2001 | Webber | 482/142 |

* cited by examiner

*Primary Examiner*—Jerome Donnelly

(57) ABSTRACT

Various exercise systems include first and second selectorized dumbbell assemblies; and a frame having first and second weight supports to support respective dumbbell assemblies. Generally speaking, the systems assume multiple configurations to facilitate both use and storage of the dumbbell assemblies. Many of the systems include at least one body supporting platform that is movable between a first position that is suitable for exercise, and a second position that is suitable for transportation and/or storage.

15 Claims, 25 Drawing Sheets

300
310
319
350
322
330

381
385
300
388
317
318
310
350
311
322
330

322
300
318
381
313
386
388
315
334
380
314
310
333
330
316
317
311
332

Fig. 28
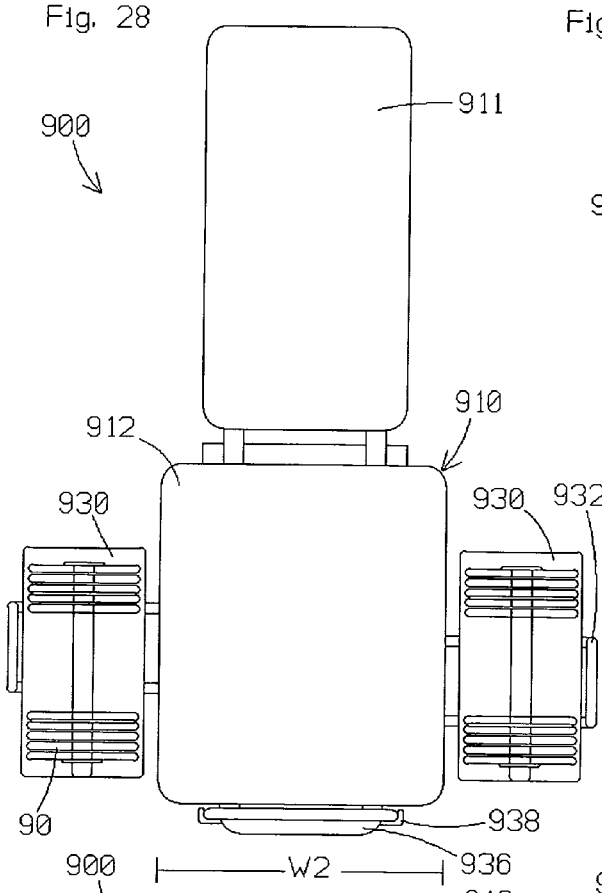
Fig. 30
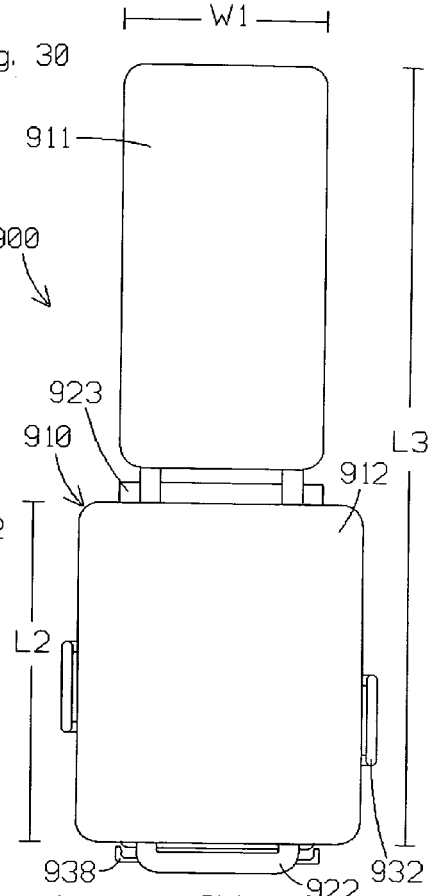
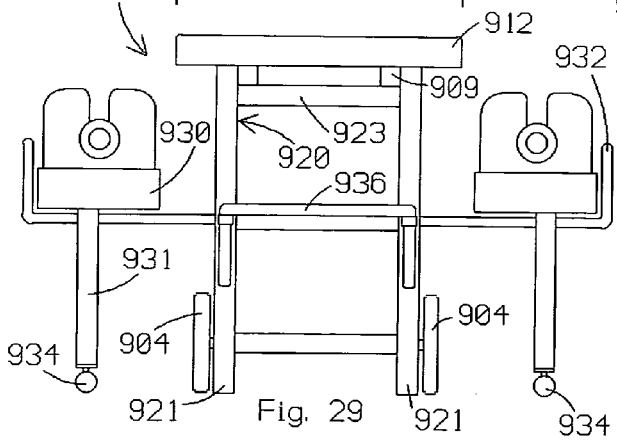
Fig. 29
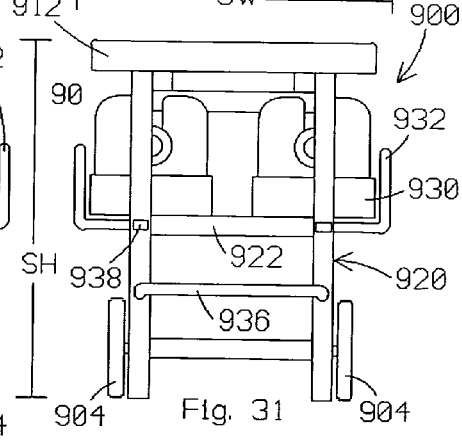
Fig. 31

Fig. 36
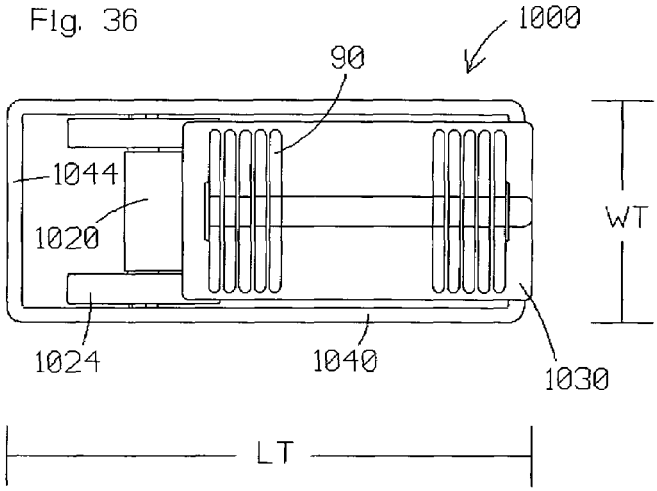
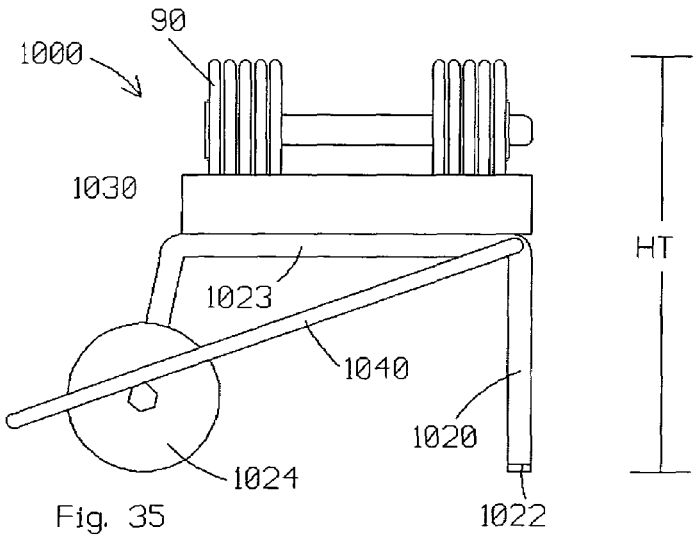
Fig. 35
Fig. 37
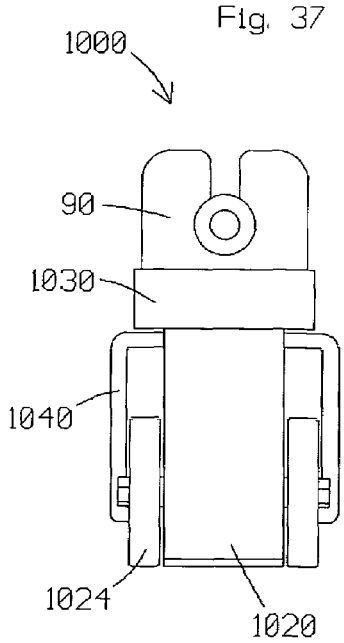

Fig. 41
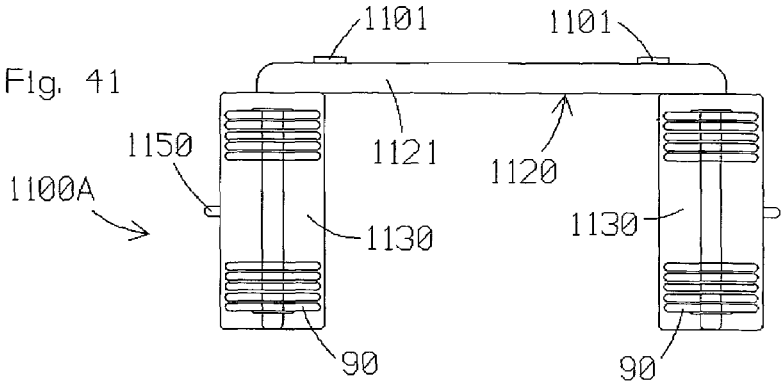
Fig. 42
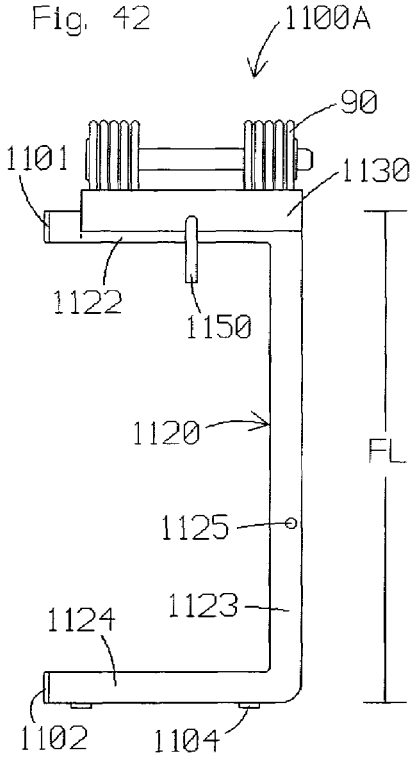
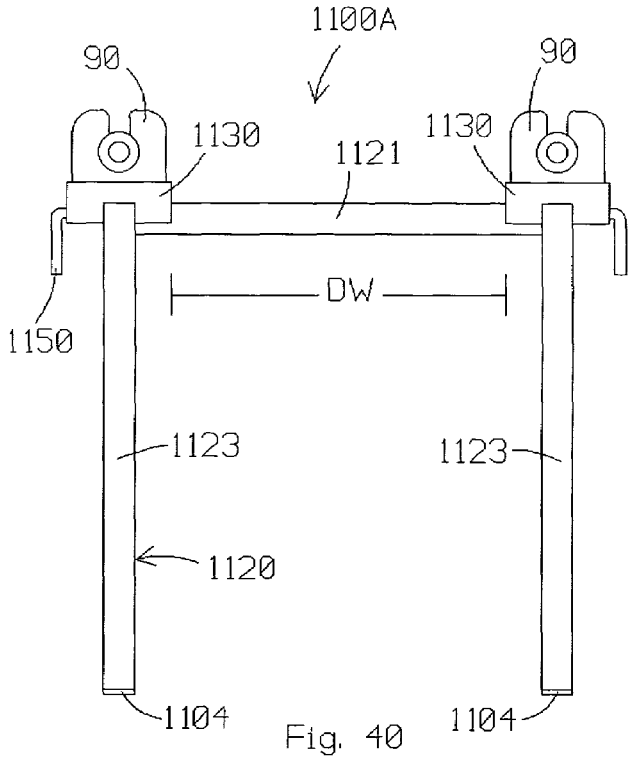
Fig. 40

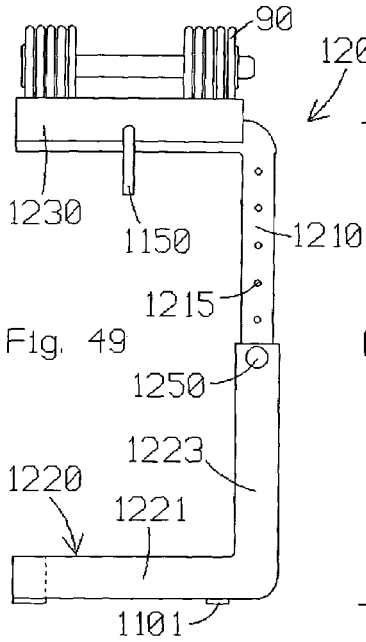
Fig. 49
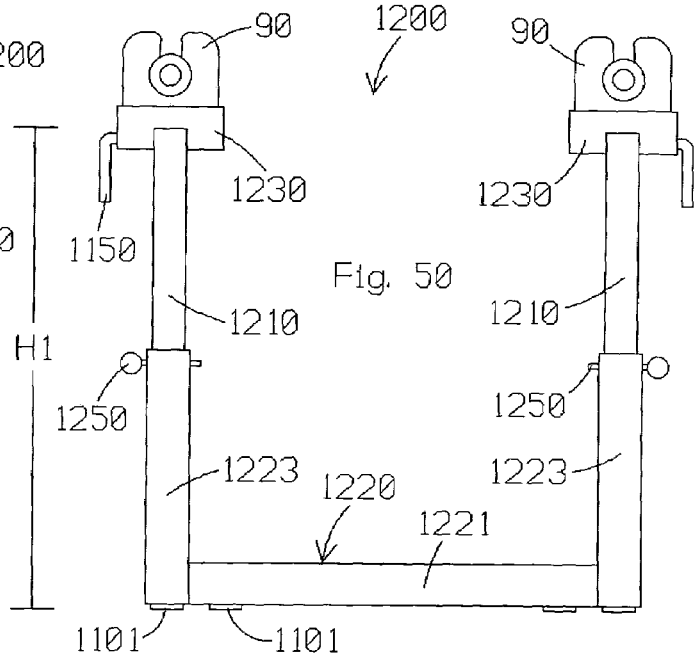
Fig. 50
Fig. 51
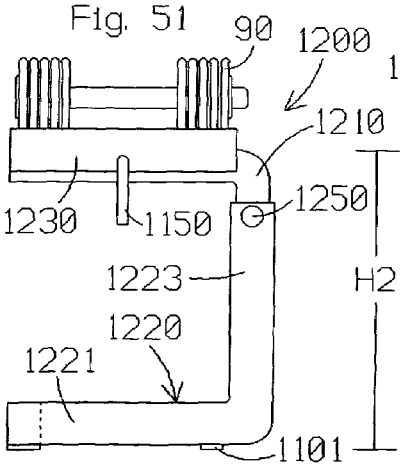
Fig. 52
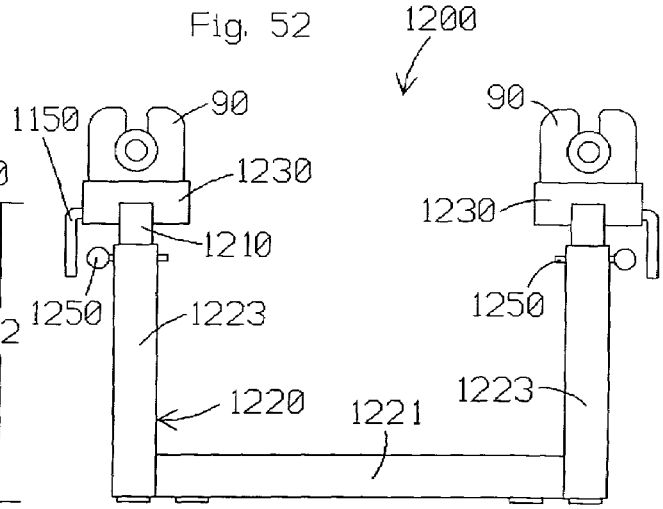

METHODS AND APPARATUS FOR SUPPORTING SELECTORIZED DUMBBELLS

CROSS-REFERENCE TO RELATED APPLICATIONS

This is a continuation-in-part of U.S. patent application Ser. No. 10/212,833, filed on Aug. 5, 2002 now U.S. Pat. No. 7,156,782.

FIELD OF THE INVENTION

The subject invention relates to exercise methods and apparatus, and more specifically, to methods and apparatus for supporting selectorized dumbbells.

BACKGROUND OF THE INVENTION

Many different types of exercise equipment are known in the art. One popular form of equipment is the exercise dumbbell, which is typically designed with one or more weights disposed at each end of a handle. Relatively more advanced dumbbell systems provide a plurality of weights in alignment with the handle and configured to be selectively connected to the handle without requiring the user to handle the weights. Examples of such systems are disclosed in U.S. Pat. No. 4,822,034 to Shields; U.S. Pat. No. 4,284,463 to Shields; U.S. Pat. No. 5,637,064 to Olson et al.; U.S. Pat. No. 5,769,762 to Towley, III et al.; U.S. Pat. No. 5,839,997 to Roth et al.; U.S. Pat. No. 6,033,350 to Krull; U.S. Pat. No. 6,099,442 to Krull; U.S. Pat. No. 6,322,481 to Krull; U.S. Pat. No. 6,402,666 to Krull; U.S. Pat. No. 6,416,446 to Krull; and U.S. Pat. No. 6,422,979 to Krull. An object of the present invention is to provide methods and apparatus for supporting these sorts of dumbbell assemblies in user friendly fashion, and/or for supporting the weight plates that remain behind when the handles are lifted from the dumbbell assemblies.

SUMMARY OF THE INVENTION

The present invention may be described in terms of methods and apparatus for supporting for selectorized dumbbells. The apparatus may be described in terms of a frame adapted to rest on a floor surface; a first dumbbell assembly and a second dumbbell assembly, wherein each said dumbbell assembly includes a handle that defines a longitudinal axis, and a set of weights configured for connection to the handle; a first base or weight support and a second base or weight support, wherein each said weight support is configured to support a respective set of weights in axial alignment with one another and a respective handle, and each weight support is movably mounted on the frame for movement between respective first and second positions.

According to one aspect of the present invention, the weight supports move relative to the frame to remain upright in each of the positions as the frame is adjusted between two different orientations relative to an underlying floor surface. According to another aspect of the present invention, the weight supports are pivotally connected to the frame for pivoting about a horizontal axis in a manner that maintains the weight supports in an upright orientation in each of the positions. According to yet another aspect of the present invention, a body supporting platform is mounted on the frame, and the weight supports pivot about a horizontal axis relative to the platform to move between the first and second positions. According to still another aspect of the present invention, a body supporting platform is mounted on the frame, and the weight supports move between respective first positions underlying the platform, and respective second positions out from under the platform.

The methods of the present invention may be described in terms of providing a frame adapted to rest on a floor surface; providing a first dumbbell assembly and a second dumbbell assembly, wherein each said dumbbell assembly includes a handle that defines a longitudinal axis; a set of weights configured for connection to the handle; and a base or weight support configured to support a respective set of weights in alignment with the handle.

According to one aspect of the present invention, additional method steps include pivotally mounting the weight supports on the frame, and constraining the weight supports to pivot together about a horizontal axis relative to the frame. This method may be implemented to keep the weight supports in an orientation upright relative to the frame.

According to another aspect of the present invention, additional method steps include movably mounting the weight supports on the frame, and maneuvering the frame between a first, relatively high profile orientation relative to the floor surface, and a second, relatively low profile orientation relative to the floor surface. This method may further include the step of mounting body supporting platforms on the frame in such a manner that a respective platform is available for use in each said orientation of the frame.

According to yet another aspect of the present invention, additional method steps include mounting a body supporting platform on the frame, pivotally mounting the weight supports on the frame, and selectively pivoting the weight supports between respective storage positions beneath the body supporting platform, and respective operative positions out from under the body supporting platform. This method may be implemented by pivoting the weight supports about a horizontal axis relative to the frame, and/or in a manner that maintains the weight supports in respective, upright orientations.

In still another respect, the present invention may be described in terms of converting an exercise bench into a weight cart and/or for converting a weight cart into an exercise bench. In a first configuration, a bench member extends upward from a weight container, and an upper end of the bench member is within arm's reach for tilting and maneuvering the apparatus with the assistance of wheels on the container and/or the bench member. In a second configuration, the bench member occupies a horizontal orientation suitable for supporting a person in a supine position. Recognizing that the wheels may be locked against rotation or eliminated from the apparatus, the present invention may also be described in terms of an exercise bench that moves between operative and inoperative positions relative to weight supports. Those skilled in the art will also recognize that the present invention is applicable to other types of body supporting equipment, including aerobic steps, for example. Additional features and/or advantages of the present invention may become apparent from the more detailed description that follows.

BRIEF DESCRIPTION OF THE DRAWING

With reference to the Figures of the Drawing, wherein like numerals represent like parts and assemblies throughout the several views.

FIG. 28 is a top view of a ninth exercise system constructed according to the principles of the present invention and configured as an exercise bench with opposite side, selectorized dumbbells deployed for use;

FIG. 29 is a front view of the system shown in FIG. 28 and configured in similar fashion;

FIG. 30 is a top view of the system of FIG. 28 with the dumbbells retracted to a storage position beneath the bench;

FIG. 31 is a front view of the system shown in FIG. 30 and configured in similar fashion;

FIG. 33 is a side view of the system of FIGS. 30-31 reconfigured as a two-wheel dolly;

FIG. 34 is a side view of the system of FIGS. 30-31 reconfigured for compact storage;

FIG. 35 is a side view of a tenth exercise system constructed according to the principles of the present invention;

FIG. 36 is a top view of the system of FIG. 36;

FIG. 37 is a front view of the system of FIG. 36;

FIG. 40 is a front view of an eleventh exercise system constructed according to the principles of the present invention and configured to accommodate a standing user;

FIG. 41 is a top view of the system of FIG. 40;

FIG. 42 is a side view of the system of FIG. 40;

FIG. 49 is a side view of a twelfth exercise system constructed according to the principles of the present invention and configured to accommodate a standing user;

FIG. 50 is a front view of the system of FIG. 49;

FIG. 51 is a side view of the system of FIG. 49 reconfigured to accommodate a seated user;

FIG. 52 is a front view of the system shown in FIG. 51 and configured in similar fashion;

DETAILED DESCRIPTION OF THE PREFERRED EMBODIMENT

Figure 1:
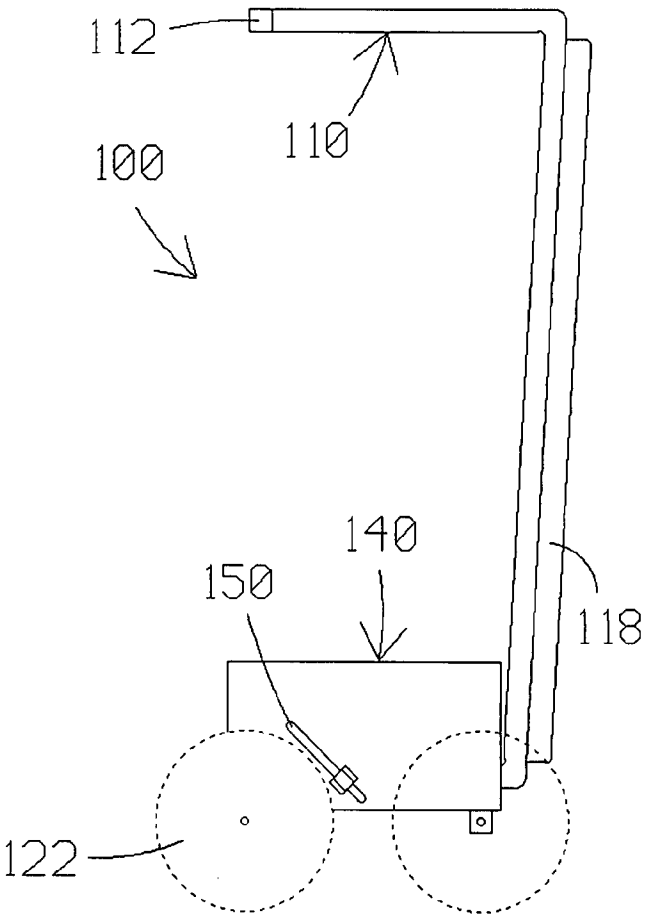
FIG. 1 is a side view of a first exercise system constructed according to the principles of the present invention and including a weight container, an exercise bench, and an aerobic step interconnected in a transport configuration.
Figure 2:
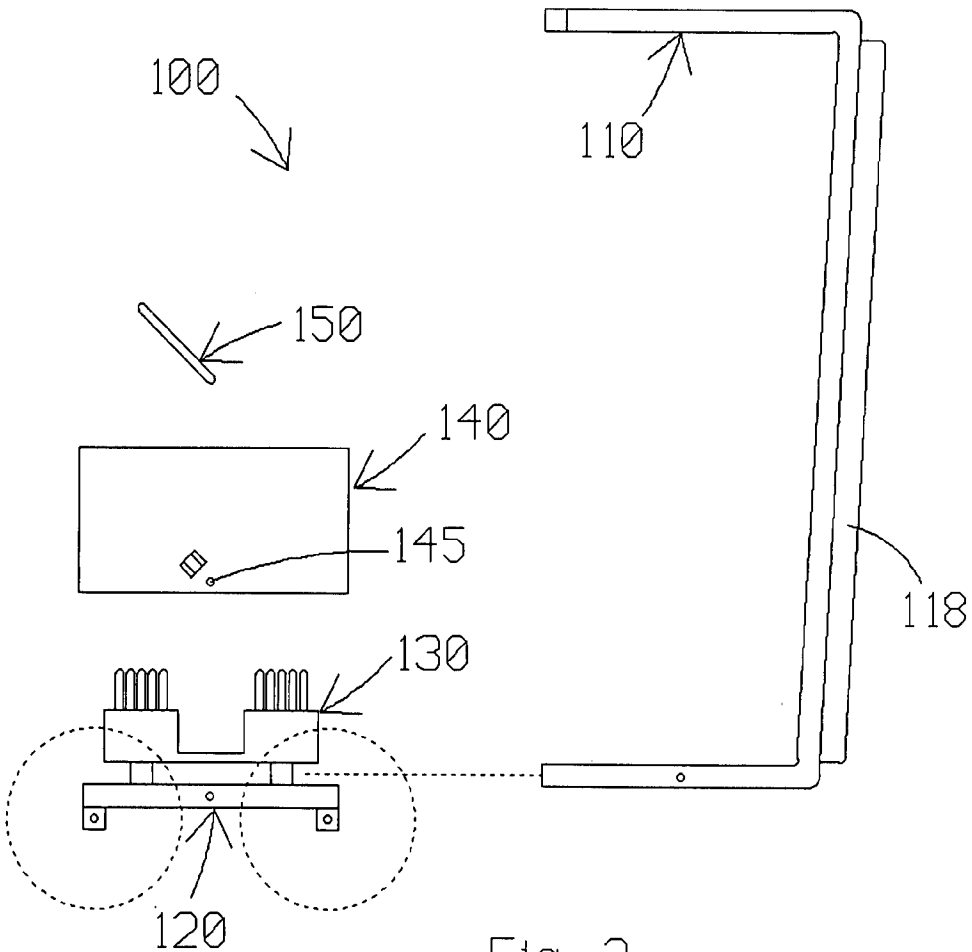
FIG. 2 is an exploded side view of the system of FIG. 1.
Figure 4C:
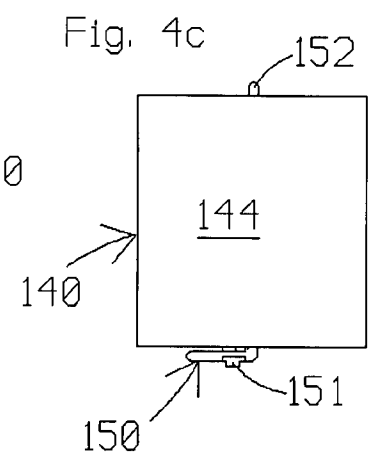
FIG. 4*c* is a top view of the aerobic step of FIG. 3*c;*

An exercise system constructed according to the principles of the present invention is designated as 100 in FIGS. 1-2. The system 100 may be described in terms of an exercise bench 110; a weight set including a weight container 130 on a cart 120; an aerobic step 140; and a connecting bar 150 which selectively interconnects the aforementioned components in the configuration shown in FIG. 1.

Figure 3C:
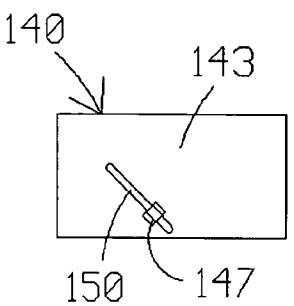
FIG. 3*c* is a side view of the aerobic step of FIG. 1 in an exercise configuration on a floor surface.
Figure 3B:
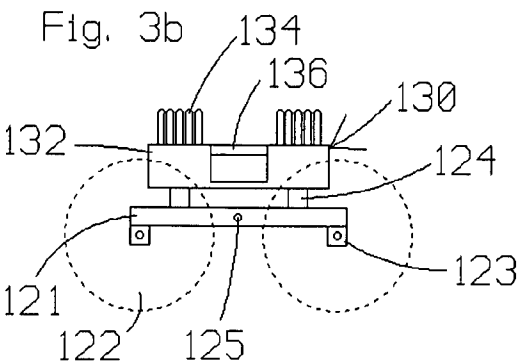
FIG. 3*b* is a side view of the weight container of FIG. 1 in an exercise configuration on a floor surface.
Figure 3A:
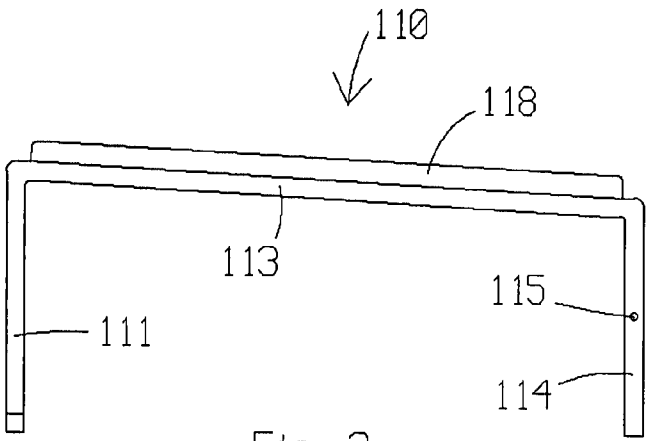
FIG. 3*a* is a side view of the exercise bench of FIG. 1 in an exercise configuration on a floor surface.

The bench 110 is shown by itself in FIGS. 3*a* and 3*b*. Generally speaking, the bench 110 includes a padded support or body supporting platform 118 mounted on a support frame in a manner known in the art. When the bench 110 occupies the generally horizontal position shown in FIG. 3*a*, the support 118 is sized and configured to support a person in a supine position with feet resting on the floor forward of the bench 110 and/or on opposite sides of the bench 110. The support frame includes intermediate members 113 which underlie the padded support 118; first legs 111 that extend generally perpendicularly away from the members 113 proximate a first end of the bench 110; and second legs 114 that extend generally perpendicularly away from the members 113 proximate a second, opposite end of the bench 110. Feet 112 extend generally perpendicularly away from distal ends of respective legs 111 and in opposite directions away from one another. Holes 115 extend transversely through respective legs 114 to receive the connecting bar 150, as further explained below.

Figure 4B:
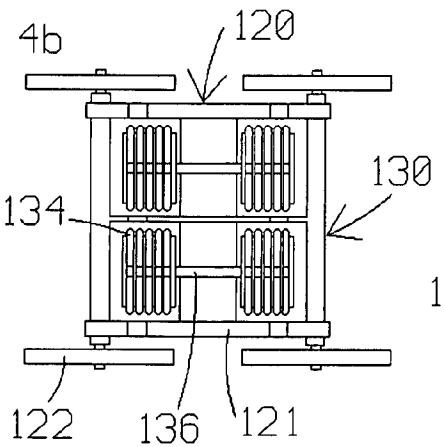
FIG. 4*b* is a top view of the weight container of FIG. 3*b;*
Figure 4A:
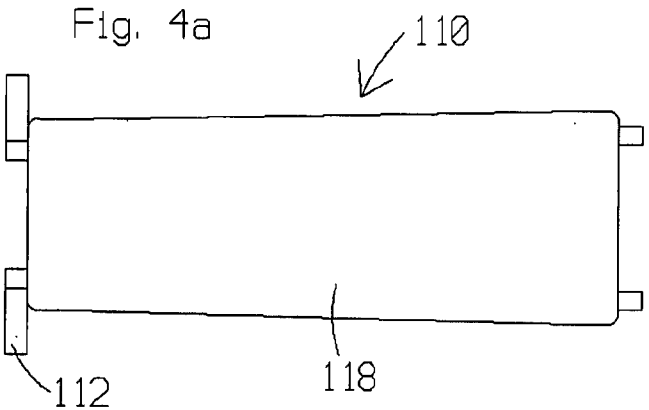
FIG. 4*a* is a top view of the exercise bench of FIG. 3*a;*

The cart 120 and the weight container 130 are shown alone in FIGS. 4*a* and 4*b*. Generally speaking, the cart 120 is designed to support the weight container 130 (and an associated weight set) and to roll across a floor surface. The cart 120 includes a generally rectangular frame 121, and wheels 122 that are rotatably mounted on the frame 121 at respective corners thereof. Various types of known locking arrangements may be provided on one or more of the wheels 122 to selectively prevent the cart 120 from rolling across a floor surface. A hole 125 extends transversely through the frame 121 to receive the connecting bar 150, as further explained below. The weight container 130 (comprising left and right weight supports) is mounted on the cart 120 and includes upwardly opening boxes or cradles 132 which are sized and configured to receive and support weight plates 134 in respective, upwardly opening compartments or slots.

On the depicted embodiment 100, the plates 134, cradles 132, and associated dumbbell handles 136 are of the type disclosed in U.S. Pat. No. 5,839,997 to Roth et al., which is incorporated herein by reference. However, those skilled in the art will recognize that the present invention is not limited to this particular type of weight plate and/or weight plate holder. For example, the present invention may be used various sorts of selectorized dumbbells and/or associated weight plate holders, including those disclosed in U.S. Pat. Nos. 4,822,034 and 5,284,463 to Shields; U.S. Pat. Nos. 5,637,064 and 5,769,762 to Towley III and Olson et al., all of which are incorporated herein by reference. Still more examples of suitable weight sets are disclosed in U.S. Pat. No. 6,033,350 to Krull; U.S. Pat. No. 6,099,442 to Krull; U.S. Pat. No. 6,322,481 to Krull; U.S. Pat. No. 6,402,666 to Krull; U.S. Pat. No. 6,416,446 to Krull; and U.S. Pat. No. 6,422,979, which are also incorporated herein by reference. Moreover, persons skilled in the art may deem it desirable to modify certain embodiments of the present invention to accommodate entirely different types of weights, including, for example, traditional fixed weight dumbbells and/or weight plates of the type that fit onto the ends of a bar.

The aerobic step 140 is shown by itself in FIGS. 5*a* and 5*b*. The step 140 is sized and configured to support a person in a standing position with one or both feet positioned on the step 140 (when positioned as shown in FIG. 3*c*). The step 140 includes a sidewall or base portion 143 and an upwardly facing support surface or body supporting platform 144. The step 140 may also be described as a downwardly opening box sized and configured to house the weight container 130. A hole 145 extends transversely through the base portion 143 to receive the connecting bar 150, as further explained below. Also, a catch or clip 147 is mounted on one side of the base portion 143, proximate the hole 145, to selectively maintain the connecting bar 150 in a latched position relative to the step 140.

The connecting bar 150 is an L-shaped bar having a relatively shorter segment 151 that functions both as a handle and as a latch, and a relatively longer segment 152 that functions to interconnect the other components. In this regard, the legs 114 of the bench 110 are sized and configured for insertion into the cart 120, between the relatively lower transverse members designated as 123 in FIG. 3*b*, and the relatively higher transverse members designated as 124 in FIG. 3*b*. When the distal ends of the legs 114 encounter a stop proximate the front of the cart 120, the holes 115 in the legs 114 align with the hole 125 in the cart 120. Also, when the step 140 is positioned on top of the cart 120, between the wheels 122 and straddling the weight container 130, the hole 145 similarly aligns with the hole 125 in the cart 120. In this capacity, the step 140 provides the additional functions of both covering and containing the weight plates 134.

The aligned holes 145, 125, and 115 are sized and configured to receive the distal end of the longer segment 152 of the connecting bar 150. As the opposite, handle segment 151 approaches the sidewall 143 of the step 140, it is rotated toward a two o'clock orientation in order to clear both the catch 147 and the wheels 122. Upon full insertion, the handle segment 151 is rotated toward a ten o'clock orientation and snapped into place between the clip 147 and the sidewall 143 of the step 140. As shown in FIG. 1, when all of the components are properly interconnected, the entire system 100 is rollable across a floor surface as a unit. The transversely extending feet 112 on the generally vertical bench 110 are available as handles to facilitate maneuvering of the system 100 in this configuration.

Figures 5, 6, 7:
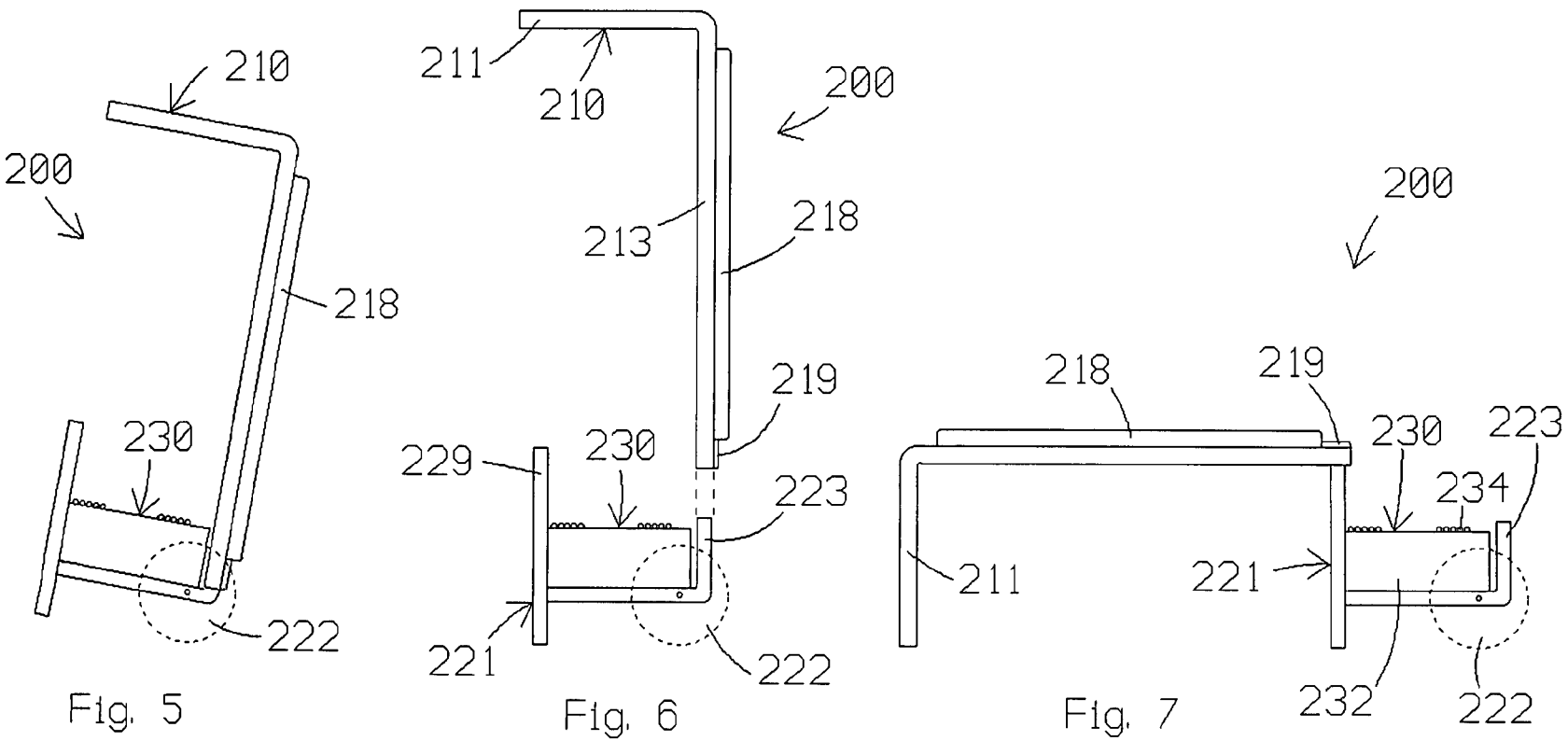
FIG. 5 is a side view of a second exercise system constructed according to the principles of the present invention and including a weight container and an exercise bench interconnected in a transport configuration.
FIG. 6 is an exploded side view of the system of FIG. 5.
FIG. 7 is a side view of the weight container and exercise bench of FIG. 5 interconnected in an exercise configuration.

Another exercise system constructed according to the principles of the present invention is designated as 200 in FIGS. 5-7. The system 200 may be described in terms of an exercise bench 210 and a weight container 230, which are selectively interconnected in either of two configurations. In a first configuration, shown in FIG. 5, the bench 210 occupies a generally vertical orientation, and the system 200 may be described as a two-wheel dolly. In a second configuration, shown in FIG. 7, the bench 210 occupies a generally horizontal orientation suitable for supporting a person in a supine position with feet resting on the floor forward of the bench 210 and/or on opposite sides of the bench 210.

Generally speaking, the bench 210 includes a padded support or body supporting platform 218 that is mounted on a support frame in a manner known in the art. The support frame includes intermediate members 213 that underlie the padded support 218, and legs 211 that extend generally perpendicularly away from the members 213 proximate a first end of the bench 210. A reinforcing plate 219 is secured across the ends of the members 213 opposite the legs 211.

The weight container 230 (comprising left and right weight supports) includes a support frame 221, and wheels 222 that are rotatably mounted on opposite sides of the frame 221 proximate a first end thereof. Legs 229 are mounted on an opposite end of the frame 221 and cooperate with the wheels 222 to maintain the system 200 in a stable position on an underlying floor surface. Various types of known locking arrangements may be provided on one or more of the wheels 222 to selectively prevent the system 200 from rolling across the floor surface. Those skilled in the art will also recognize that the wheels 222 could be replaced by another pair of legs if a more stationary device is preferred. The weight container 230 includes upwardly opening boxes or cradles 232 that are sized and configured to receive and support weight plates 234 for a selectorized dumbbell like any those mentioned above with reference to the first embodiment 100.

The members 213 on the bench 210 are square tubes which are sized and configured to receive the upwardly extending, distal ends of the legs 229 or the posts 223 on the frame 221. With respect to the legs 229 (and with reference to FIG. 7), holes are provided in the downwardly facing sides of the tubes 213 to receive the upper ends of the legs 229. With respect to the posts 223 (and with reference to FIG. 6), the open ends of the tubes 213 fit over the upper ends of the posts 223. In each arrangement, aligned holes may be provided in the overlapping members to accommodate a connecting bar for purposes of more securely interconnecting the two components.

Figure 8:
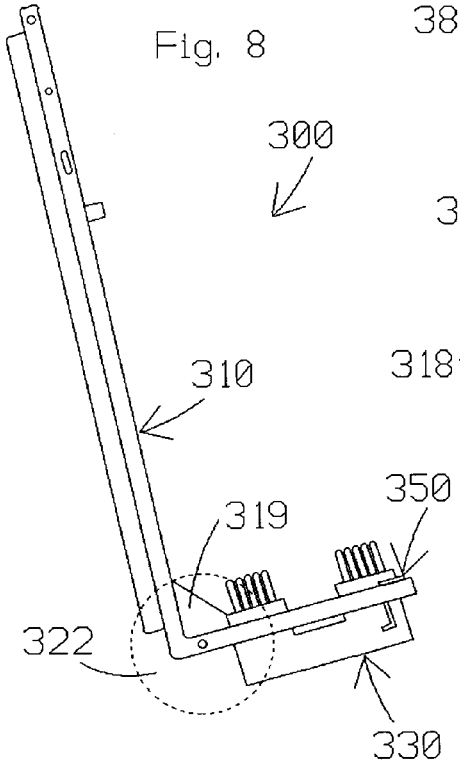
FIG. 8 is a side view of a third exercise system constructed according to the principles of the present invention and including a weight container and an exercise bench interconnected in a transport configuration.
Figure 9:
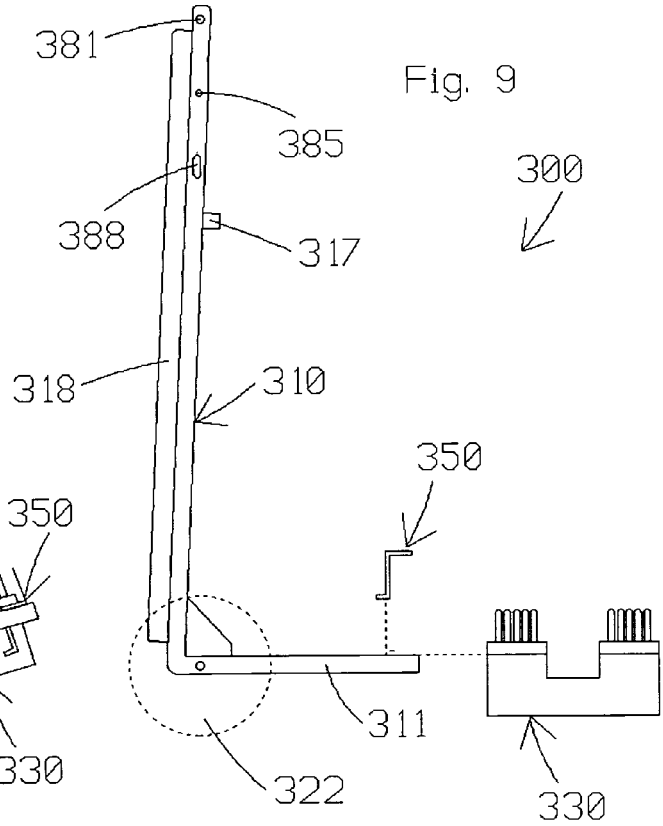
FIG. 9 is an exploded side view of the system of FIG. 8.
Figure 10:
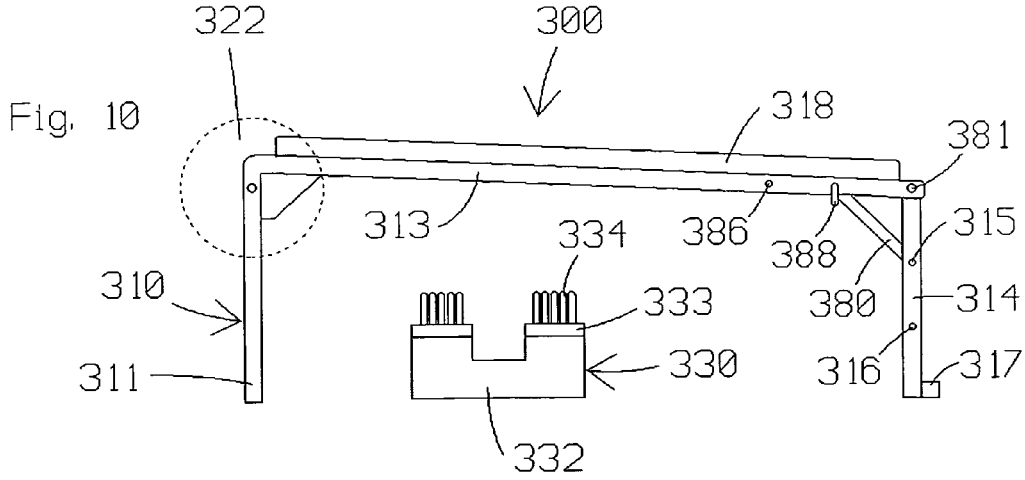
FIG. 10 is a side view of the weight container and the exercise bench in an exercise configuration on a floor surface.

Yet another exercise system constructed according to the principles of the present invention is designated as 300 in FIGS. 8-10. The system 300 may be described in terms of an exercise bench 310; a weight container 330 and associated weights; and a connecting bar 350 that selectively interconnects the aforementioned components in the configuration shown in FIG. 8.

Generally speaking, the bench 310 includes a padded support or body supporting platform 318 mounted on a support frame in a manner known in the art. When the bench 310 occupies the generally horizontal position shown in FIG. 10, the support 318 is sized and configured to support a person in a supine position with feet resting on the floor forward of the bench 310 and/or on opposite sides of the bench 310. The support frame includes intermediate members 313 that underlie the support 318. First legs 311 extend generally perpendicularly away from the members 313 proximate a first end of the bench 310. Reinforcing flanges 319 are interconnected between respective legs 311 and respective members 313. Wheels 322 are rotatably mounted on opposite sides of the frame proximate the juncture between the legs 311 and the members 313.

Second legs 314 are pivotally connected to respective members 313 proximate a second, opposite end of the bench 310 (at pin joints 381). A foot member 317 is interconnected between the opposite, lower ends of the legs 314 and extends outwardly in opposite directions therefrom. Brackets 380 have first ends that are pivotally connected to respective legs 314 at pin joints 315. When the bench 310 is configured as shown in FIG. 10, opposite, second ends of the brackets 380 are releasably connected to the members 313 by means of a connecting bar 388 inserted through holes 385 in the members 313 and aligned holes in the ends of the brackets 380.

When the bench 310 is configured as shown in FIG. 9, the connecting bar 388 is inserted through holes 386 in the members 313 and aligned holes 316 in the legs 314, as well as through the holes in the movable ends of the brackets 380. In this configuration, the opposite ends of the foot 317 are available for use as handles in maneuvering the system 300 like a two-wheel dolly. Those skilled in the art will recognize that the collapsible legs 314 on this embodiment 300 may be provided on other embodiments, such as the first embodiment 100, and conversely, that the collapsible legs 314 on this embodiment 300 may be replaced by rigidly secured legs, such as those designated as 114 on the first embodiment 100.

The weight container 330 (comprising left and right weight supports) includes upwardly opening boxes or cradles 332 that are sized and configured to receive and support weight plates 334 similar to any of those mentioned above with reference to the preceding embodiments. Ledges or shoulders 333 extend lengthwise along opposite sides of the weight container 330 to facilitate connection of same to the bench 310. In this regard, when the bench 310 occupies the generally vertical orientation shown in FIG. 9, the wheels 322 rest upon the floor, and the legs 311 on the bench 310 are maneuverable directly beneath the ledges 333 on the weight container 330. When the leading edges of the brackets 319 engage the near end of the weight container 330, a slot in one of the ledges 333 aligns with a slot in the leg 311 to receive the generally Z-shaped connecting bar 350, which is inserted through the aligned slots and rotated to discourage the legs 311 from dropping to the floor. The resulting configuration is shown in FIG. 8, and may be described as a two-wheel dolly.

Figure 11:
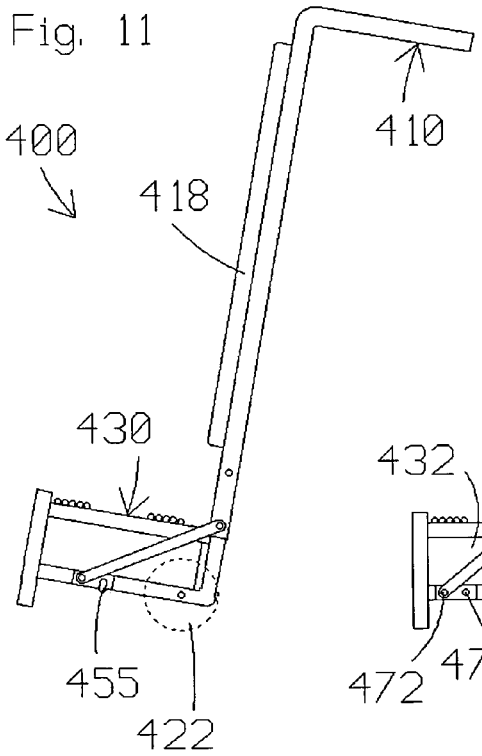
FIG. 11 is a side view of a fourth exercise system constructed according to the principles of the present invention and including a weight container and an exercise bench interconnected in a transport configuration.
Figure 12:
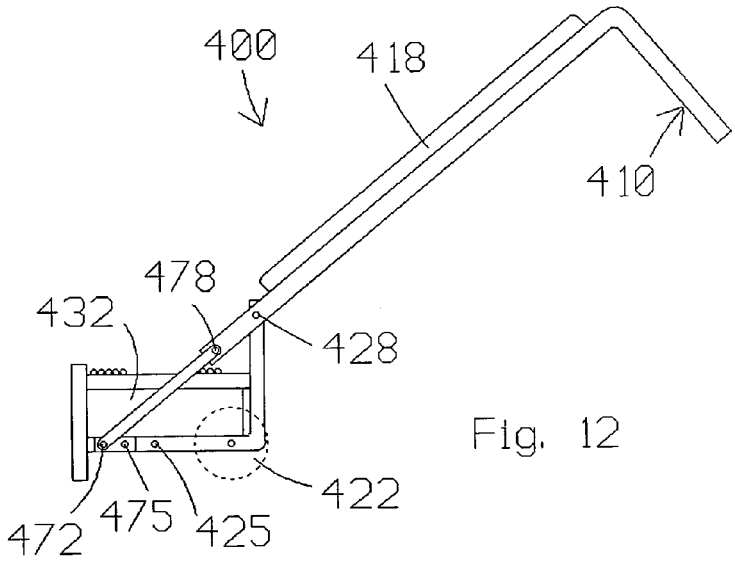
FIG. 12 is a side view of the system of FIG. 11 in a state of transformation.
Figure 13:
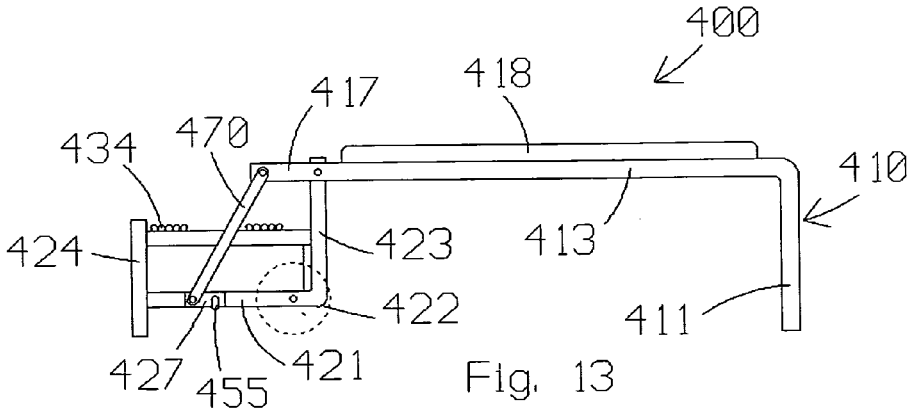
FIG. 13 is a side view of the system of FIG. 11 with the weight container and the exercise bench interconnected in an exercise configuration.

Still another exercise system constructed according to the principles of the present invention is designated as 400 in FIGS. 11-13. The system 400 may be described in terms of an exercise bench 410 and a weight container 430, which are interconnected and transformable between at least two configurations. In a first configuration, shown in FIG. 11, the bench 410 occupies a generally vertical orientation, and the system 400 may be described as a two-wheel dolly. In a second configuration, shown in FIG. 13, the bench 410 occupies a generally horizontal orientation suitable for supporting a person in a supine position with feet resting on the floor forward of the bench 410 and/or on opposite sides of the bench 410.

Generally speaking, the bench 410 includes a padded support or body supporting platform 418 mounted on a support frame in a manner known in the art. The support frame includes intermediate members 413 that underlie the padded support 418, and legs 411 that extend generally perpendicularly away from the members 413 proximate a first end of the bench 410.

The weight container 430 (comprising left and right weight supports) includes a support frame 421, and wheels 422 rotatably mounted on opposite sides of the frame 421 proximate a first end thereof. Legs 424 are mounted on an opposite end of the frame 421 and cooperate with the wheels 422 to maintain the system 400 in a stable position on an underlying floor surface. Those skilled in the art will recognize that various types of known locking arrangements may be provided on one or more of the wheels 422 to selectively prevent the system 400 from rolling across the floor surface, or that the wheels 422 could be replaced by another pair of legs if a more stationary device is preferred. The weight container 430 further includes upwardly opening boxes or cradles 432 that are sized and configured to receive and support weight plates 434 like any of those mentioned above with reference to the preceding embodiments.

Posts 423 extend upward on the frame 421 proximate the wheels 422. The members 413 are pivotally connected to respective posts 423 at pivot points 428. Extensions 417 of the members 413 extend beyond the pivots points 428 and are pivotally connected to respective brackets 470 at pivot points 478. Opposite ends of the brackets 470 are pivotally connected to respective slides 427 at pivot points 472. The slides 427 are movable along respective sides of the frame 421 between the legs 424 and the wheels 422. The slides 427 are sufficiently wide (and/or supplemented with spacers) to offset the lateral space occupied by the members 413, so that the brackets 470 occupy respective vertical planes extending perpendicular to the pivot axes 478 and 472. Holes 475 extend laterally through respective slides 427 and align with holes 425 in the frame 421 when the system 400 is configured as shown in FIG. 11 or FIG. 13. In either case, a connecting bar 455 may be inserted through the aligned holes 475 and 425 to latch the components relative to one another. Those skilled in the art will also recognize that a bias may be exerted against the bench 410 to offset a portion of its weight. For example, a torsion spring may be interconnected between the members 413 and the posts 423 to help urge the bench 410 toward a vertical orientation relative to the weight container 430.

Figures 14, 15, 16:
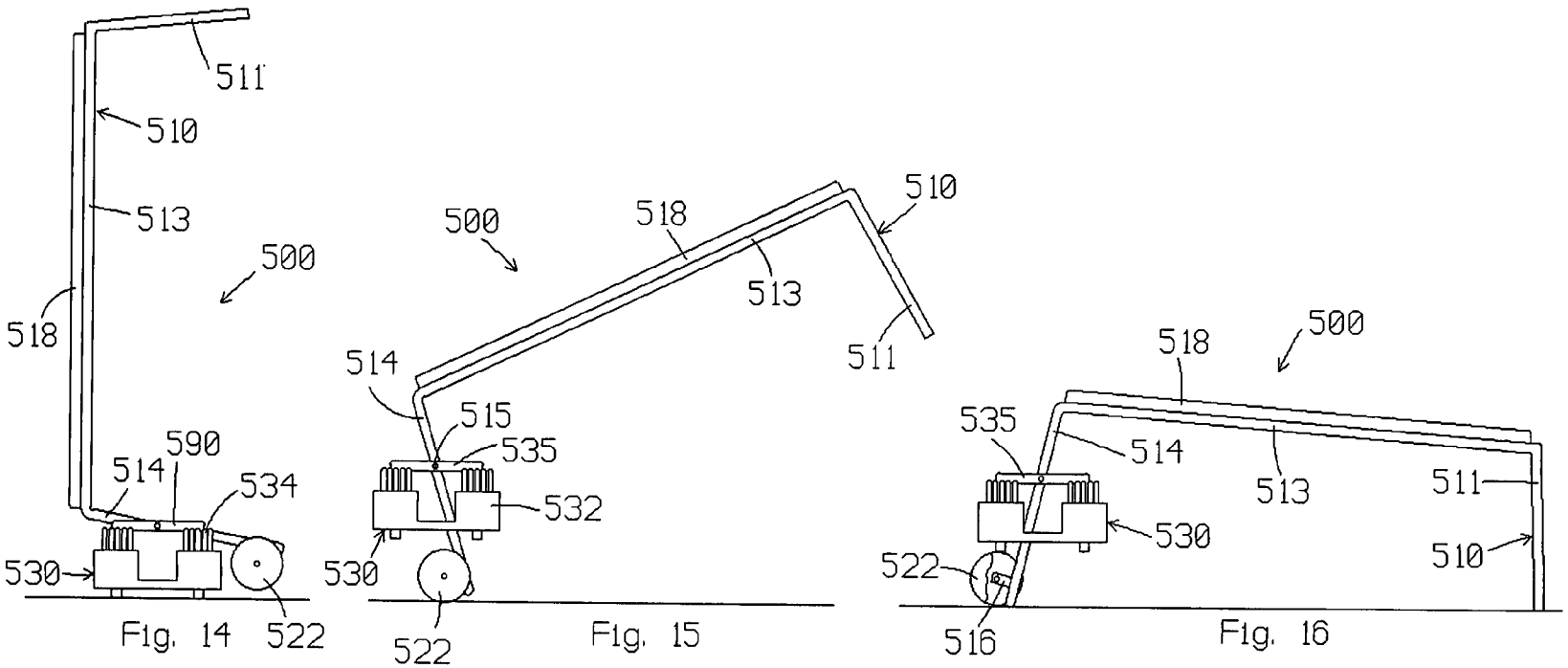
FIG. 14 is a side view of a fifth exercise system constructed according to the principles of the present invention and including a weight container and an exercise bench which are interconnected and shown in a storage configuration.
FIG. 15 is a side view of the system of FIG. 14 in a transport configuration.
FIG. 16 is a side view of the system of FIG. 14 in an exercise configuration.

Still another exercise system constructed according to the principles of the present invention is designated as 500 in FIGS. 14-16. The system 500 may be described in terms of an exercise bench 510 and a weight container 530, which are interconnected and transformable into at least three different configurations. In a first configuration, shown in FIG. 14, only the weight container 530 rests upon an underlying floor surface, and the system 500 is configured for storage. In a second configuration, shown in FIG. 15, only wheels 522 rest upon the floor surface, and the system 500 is configured for mobility. In a third configuration, shown in FIG. 16, only the bench 510 rests upon the floor surface, and the system 500 is configured for exercise purposes.

Generally speaking, the bench 510 includes a padded support or body supporting platform 518 mounted on a support frame in a manner known in the art. When arranged as shown in FIG. 16, the support 518 is sized and configured to support a person in a supine position with feet resting on the floor forward of the bench 510 and/or on opposite sides of the bench 510. The support frame includes intermediate members 513 that underlie the padded support 518; legs 511 that extend generally perpendicularly away from the members 513 proximate a first end of the bench 510; and legs 514 that extend generally perpendicularly away from the members 513 proximate an opposite, second end of the bench 510. Posts 516 extend generally perpendicularly away from the legs 514 proximate the lower, distal ends thereof., and the wheels 522 are rotatably mounted on the posts 516.

The weight container 530 includes left and right, upwardly opening weight supports or cradles 532 which are sized and configured to receive and support weight plates 534 like any of those mentioned above with reference to the preceding embodiments. The cradles 532 have upwardly disposed beams 535 which are pivotally connected to respective legs 514, intermediate the support 518 and the wheels 522, at pin joints 515. As a result of these pivotal connections, which define a horizontal pivot axis between the bench 510 and the weight container 530, the cradles 532 tend to remain in a preferred, upright orientation regardless of the orientation of the bench 510. Also, the weight of the cradles 532 and the weight plates 534 biases the bench 510 "over center" and toward either the storage configuration shown in FIG. 14 or the exercise configuration shown in FIG. 16. As suggested by the preceding disclosure of other embodiments, a connecting bar may be inserted through aligned holes in the beams 535 and the legs 514 (in the region designated as 590 in FIG. 14) to lock the system 500 in the storage configuration. Those skilled in the art will also recognize that "over-center" biasing may be used on other embodiments, as well, and that the bench itself may be used for such purposes (with or without the weight container), depending on the particular arrangement.

Figure 18:
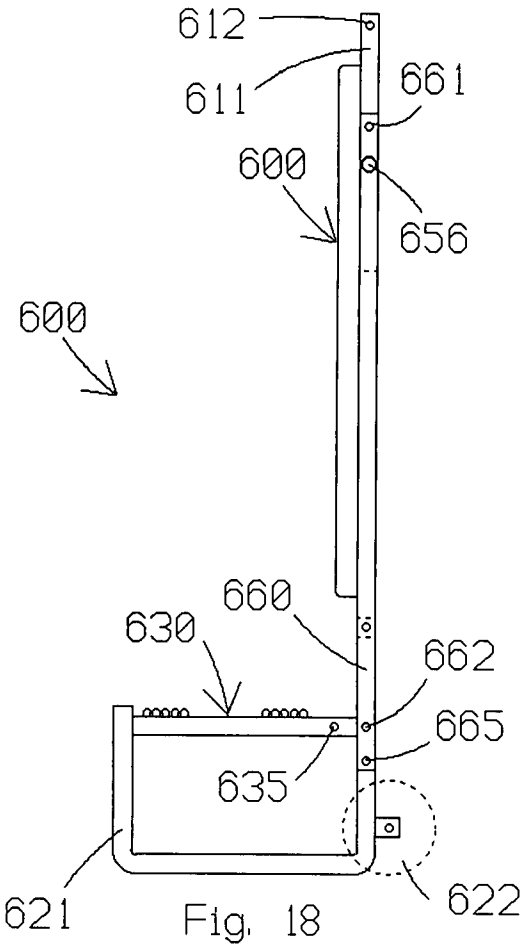
FIG. 18 is a side view of the system of FIG. 17 with the weight container and the exercise bench interconnected in a transport configuration.
Figure 17:
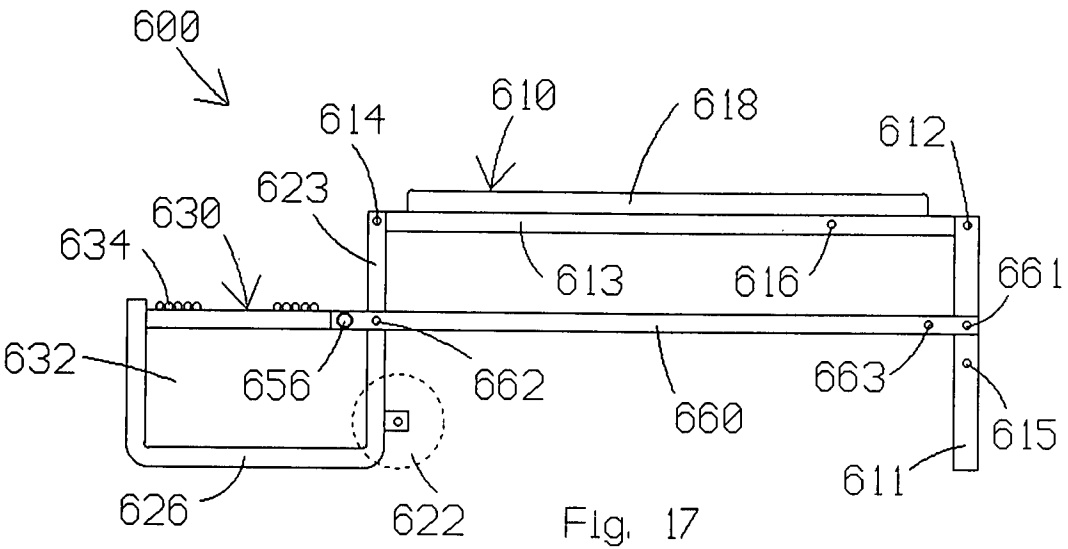
FIG. 17 is a side view of a sixth exercise system constructed according to the principles of the present invention and including a weight container and an exercise bench interconnected in an exercise configuration.

Still another exercise system constructed according to the principles of the present invention is designated as 600 in FIGS. 17-18. The system 600 may be described in terms of an exercise bench 610 and a weight container 630, which are interconnected and transformable into at least two different configurations. In a first configuration, shown in FIG. 18, the bench 610 occupies a generally vertical orientation, and the system 600 may be described as a two-wheel dolly. In a second configuration, shown in FIG. 17, the bench 610 occupies a generally horizontal orientation suitable for supporting a person in a supine position with feet resting on the floor forward of the bench 610 and/or on opposite sides of the bench 610.

Generally speaking, the bench 610 includes a padded support or body supporting platform 618 mounted on a support frame in a manner known in the art. The support frame includes intermediate members 613 that underlie the padded support 618, and legs 611 that are pivotally connected to the members 613 at pivot axis 612, proximate a first end of the bench 610. The intermediate members 613 are also pivotally connected to posts 623, proximate a second, opposite end of the bench 610, thereby defining pivot axis 614. Fourth bars or members 660 are also pivotally interconnected between respective posts 623 (at pivot axis 662) and respective legs 611 (at pivot axis 661), thereby creating respective four-bar linkages. As a result of this arrangement, the members 660 are constrained to remain parallel to the members 613, and the legs 611 are constrained to remain parallel to the posts 623, regardless of the orientation of the bench 610 relative to the weight container 630. When the system 600 is configured as shown in FIG. 17, the members 660 and 613 extend perpendicular to the legs 611 and the posts 623; and when the system 600 is configured as shown in FIG. 18, the members 660 and 613 extend parallel to the legs 611 and the posts 623.

The weight container 630 includes a support frame 621 having a floor engaging base 626, and floor engaging wheels 622 rotatably mounted on opposite sides of the frame 621 proximate a first end thereof. When the base 626 is resting flat upon an underlying floor surface, the system 600 remains stable and stationary. When the system 600 is folded into the configuration shown in FIG. 18 and tilted onto the wheels 622, the system 600 is rollable across the floor surface. Those skilled in the art will recognize that the wheels 622 are not required if a more stationary system is preferred. The weight container 630 includes left and right, upwardly opening weight supports or cradles 632 that are sized and configured to receive and support weight plates 634 like any of those mentioned above with reference to the preceding embodiments.

The members 660 extend beyond the pivot axis 662 and are provided with connector holes 665 proximate their distal ends. A similarly sized hole 635 extends through the frame 621 at a like distance from the pivot axis 662. As a result, when the system 600 is configured as shown in FIG. 17, the holes 665 and 625 align to receive a connecting bar 656 similar to any of the connecting bars described above with reference to the preceding embodiments. Those skilled in the art will recognize that other known fastening or latching arrangements may be substituted for the connecting bar (both on this embodiment and others described herein) without departing from the scope of the present invention. For example, spring biased latches could be mounted on one of the interacting members and could be selectively deflected to accommodate passage of the other member.

At the other end of the bench 610, holes 615 extend through the legs 611 at a first distance from the pivot axis 612, and at a second, relatively shorter distance from the pivot axis 661. Similarly sized holes 663 extend through the members 660 at the same second distance from the pivot axis 661, and similarly sized holes 616 extend through the members 613 at the same first distance from the pivot axis 612. As a result, when the system 600 is folded into the configuration shown in FIG. 18, the holes 663, 615, and 616 align to receive the connecting bar 656.

In each of FIGS. 17 and 18, the connecting bar 656 selectively locks the four-bar linkage in the depicted configuration. On this embodiment 600, the connecting bar 656 is sufficiently long to accommodate grips which are made of rubber and are sized and configured to slide onto opposite ends of the bar 656. The grips serve as handles and/or foot rests (depending upon the configuration of the system 600) and also maintain the bar in a locked position. Those skilled in the art will also recognize that a damper may be interconnected between members of the four-bar linkage to slow the descent of the bench 610 from the vertical orientation shown in FIG. 18 to the horizontal orientation shown in FIG. 17, and/or that a spring may be interconnected between members of the four-bar linkage to help lift the bench 610 from the horizontal orientation shown in FIG. 17 to the vertical orientation shown in FIG. 18.

Those skilled in the art will also recognize that the present invention is not limited to the particular type of exercise bench described with reference to the foregoing embodiments. For example, the system 600 may be modified to include a two-piece body support 681, 682 (and/or barbell posts 624), as shown on the system designated as 600' in FIG. 19. The posts 624 extend upward from the base 626 and upward beyond the pivotal connection with the intermediate members 613' (at pivot axis 614). Brackets 625 are mounted on top of the posts 624 to receive and support a barbell. When the system 600' is folded in the manner suggested by FIG. 18, the elongated posts 624 fit between the members 613' and the members 660, and beneath the legs 611.

Figure 19:
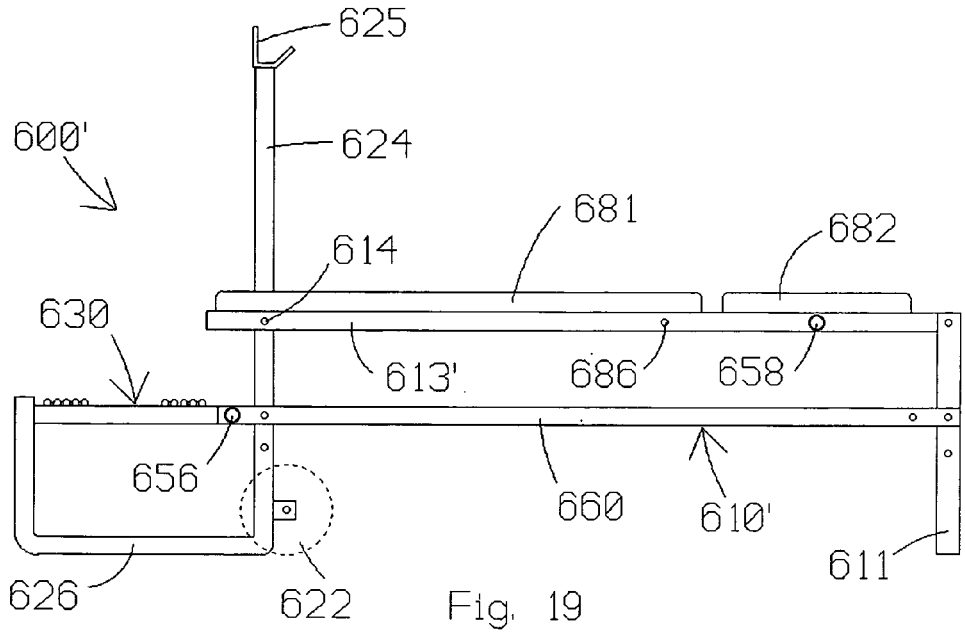
FIG. 19 is a side view of the system of FIG. 17 modified to provide a dumbbell support and a two-piece bench.
Figure 20:
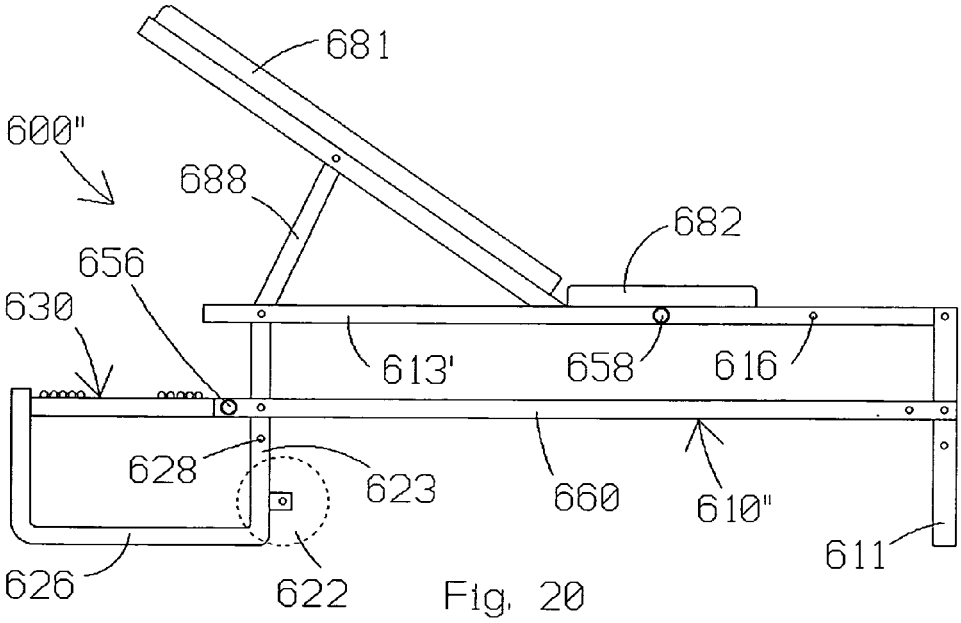
FIG. 20 is a side view of the system of FIG. 17 modified to provide a two-piece bench which is selectively inclined.

FIG. 20 shows a system 600" which includes the two-piece body support 681, 682, but not the barbell posts 624. The smaller body support 682 is movable along the intermediate supports 613', and the larger body support 681 is pivotal relative to the smaller body support 682. A brace 688 is pivotally interconnected between the larger body support 681 and the relative shorter posts 623, to selectively support the larger body support 681 in an inclined orientation relative to the intermediate supports 613'. A connecting bar 658 inserts through holes 616 or 686 in the supports 613' and aligned holes in the smaller body support 682 to maintain the supports 681, 682 in either configuration (FIG. 19 or 20, respectively). The connecting bar 658 may also be inserted through the aligned holes in the supports 613' and the legs 611 to maintain either system 600' or 600" in a folded configuration. Additional holes 628 are provided in the posts 623 or 624 to receive the other connecting bar 656 when either system 600' or 600" is folded.

The foregoing description and accompanying drawings also suggest various folding bench systems which may be practiced in the absence of a weight container. For example, the system 600 shown in FIGS. 17-18 may be modified somewhat to arrive at the apparatus designated as 800 in FIGS. 25-27. In a first configuration, shown in FIG. 25, the apparatus 800 occupies an exercise bench configuration; in a second configuration, shown in FIG. 26, the apparatus 800 occupies a transport configuration; and in a third configuration, shown in FIG. 27, the bench 800 occupies a storage configuration. The apparatus 800 is shown with optional members 833 to illustrate that it may be used as a two-wheel dolly when in the second configuration, and with optional barbell supports 825 to illustrate that it may be used for barbell exercises, as well as dumbbell exercises, when in the first configuration.

Generally speaking, the bench portion 810 of the apparatus (excluding the optional members 833) includes a padded support or body supporting platform 818 mounted on a support frame in a manner known in the art. The support frame includes intermediate members 813 that underlie the padded support 818, and legs 811 that are pivotally connected to the members 813 at pivot axis 812, proximate a first end of the bench 810. The intermediate members 813 are also pivotally connected to posts 824, proximate a second, opposite end of the bench 810, thereby defining pivot axis 814. Fourth bars or members 860 are also pivotally interconnected between respective posts 824 (at pivot axis 862) and respective legs 811 (at pivot axis 861), thereby creating respective four-bar linkages. As a result of this arrangement, the members 860 are constrained to remain parallel to the members 813, and the legs 811 are constrained to remain parallel to the posts 823 in all of the available configurations. When the apparatus 800 is configured as shown in FIG. 25, the members 860 and 813 extend perpendicular to the legs 811 and the posts 824; and when the apparatus 800 is configured as shown in FIG. 26 or FIG. 27, the members 860 and 813 extend parallel to the legs 811 and the posts 824 (and the overall height of the apparatus 800 is less than four times the width of the structural members 811, 813, 824, and 860, and less than four times the depth of the same structural members).

The members 860 extend beyond the pivot axis 862 and are provided with connector holes proximate their distal ends. A similarly sized hole extends through brackets 826 on the posts 824 at a like distance from the pivot axis 862. As a result, when the apparatus 800 is configured as shown in FIG. 25, a connecting bar 856 may be inserted through aligned holes in the members 860 and the brackets 826. At the other end of the bench 810, holes 815 extend through the legs 811 at a first distance from the pivot axis 812, and at a second, relatively shorter distance from the pivot axis 861. Similarly sized holes 863 extend through the members 860 at the same second distance from the pivot axis 861, and similarly sized holes 816 extend through the members 813 at the same first distance from the pivot axis 812. As a result, when the apparatus 800 is folded into the configuration shown in FIG. 26 or FIG. 27, the holes 863, 815, and 816 align to receive the connecting bar 856.

Figure 25:
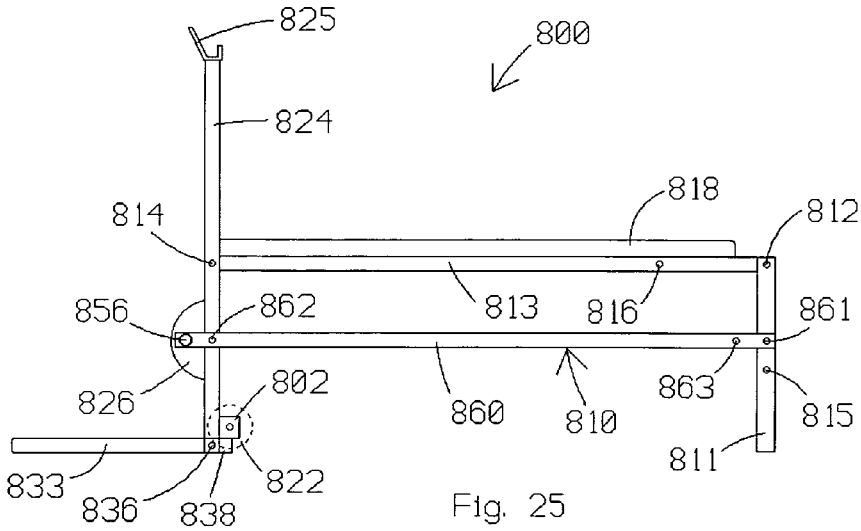
FIG. 25 is a side view of an eighth exercise system constructed according to the principles of the present invention and configured as an exercise bench.
Figure 26:
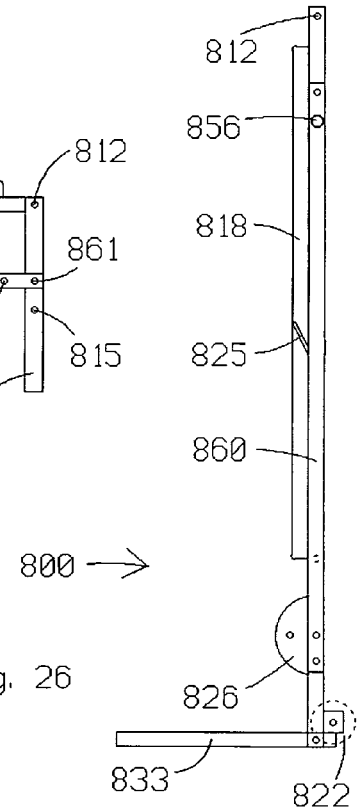
FIG. 26 is a side view of the system of FIG. 25 configured as a two-wheel dolly.
Figure 27:
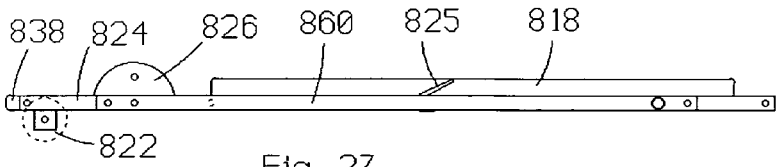
FIG. 27 is a side view of the system of FIG. 25 configured for storage.

In each of FIGS. 25-27, the connecting bar 856 selectively locks the four-bar linkage in the depicted configuration. Like on the embodiment 600, the connecting bar 856 is sufficiently long to accommodate grips which are made of rubber and are sized and configured to slide onto opposite ends of the bar 856. The grips serve as handles and/or foot rests (depending upon the configuration of the apparatus 800) and also maintain the bar in a locked position.

A bar 802 is secured transversely between the posts 824 proximate the lower ends thereof, and relatively small diameter wheels 822 are rotatably mounted on opposite ends of the bar 802. The wheels are sized and arranged to be spaced above the floor when the apparatus 800 occupies the configuration shown in FIG. 25. When the apparatus 800 occupies the configuration shown in FIG. 26, the apparatus 800 may be tilted rearward to bring the wheels 822 into contact to the floor (a completely tilted apparatus 800 is shown in FIG. 27).

The members 833 are pivotally connected to the posts 824 proximate the lower ends of the latter, thereby defining pivot axis 836. An extension 838 of each member 833 bears against the cross-bar 802 when the apparatus is configured as shown in FIG. 25 or FIG. 26, thereby countering downward force applied against the members 833 on the opposite side of the pivot axis 836. When the members 833 are rotated to the orientation shown in FIG. 27, the extensions 838 project beyond the posts 824, and the members 833 rest on the cross-bar 802 and between the posts 824.

Yet another "bench-type" exercise system constructed according to the principles of the present invention is designated as 900 in FIGS. 28-34. The system 900 may be described in terms of an exercise bench 910 and weight holders or weight supports 930 which are interconnected and may be arranged into different configurations. In a first configuration, shown in FIGS. 28-32, the bench 910 is arranged in a generally horizontal orientation suitable for supporting a person in a supine position with feet resting on the floor forward of the bench 910 and/or on opposite sides of the bench 910. In a second configuration, shown in FIG. 33, the bench 910 is folded into an L-shaped configuration, and the system 900 may be described as a two-wheel dolly. In this second configuration, the height DH of the dolly is thirteen seven and one-half inches. In a third configuration, shown in FIG. 34, the bench 910 is broken down into overlapping parts, and the system 900 is relatively compact for purposes of storage and/or transportation. In this third configuration, the system 900 has a length SL of twenty-four inches (shown in FIG. 34), a width SW of fifteen and one-half inches (shown in FIG. 31), and a height SH of eighteen inches (also shown in FIG. 31).

Generally speaking, the bench 910 includes a first padded support 911 mounted on left and right L-shaped members 909, and a second padded support 912 mounted on a frame 920. Each padded support 911 and 912 preferably includes a plywood base, a padding material disposed on top of the plywood base, and a cover disposed about the padding material and the sides of the plywood base, and secured to the bottom of the plywood base. On the embodiment 900, the padded support 911 has a width W1 of ten inches and a length L1 of twenty and one-half inches, and the padded support 912 has a width W2 of fourteen inches and a length L2 of seventeen inches. The two padded supports 911 and 912 cooperate to define a bench length L3 of thirty-nine inches (shown in FIG. 30).

The frame 920 includes left and right U-shaped members 921 that are inverted in such a manner that their distal ends engage the underlying floor surface. The frame 920 also includes an intermediate U-shaped member 922 that is arranged horizontally and interconnected between the left and right U-shaped members 921. Both a bar 923 and the support 912 are interconnected between the left and right U-shaped members 913, as well. The bar 923 is preferably secured in place by bolts and/or welding, and the support 912 is preferably secured in place by hook-and-loop fasteners and/or pegs extending downward from the support 912 and into holes in the U-shaped members 921.

When the frame 920 is resting flat on an underlying floor surface, the system 900 remains stable and stationary. Wheels 904 are rotatably mounted on the rearward distal segments of respective U-shaped members 921 so as to rest just above the floor surface when the system 900 occupies any of the positions shown in FIGS. 32-34. When the system 900 is folded into the "dolly configuration" shown in FIG. 33, it may be tilted rearward onto the wheels 904 and rolled across the floor surface. Those skilled in the art will recognize that the wheels 904 are not required if a stationary system is preferred.

Figure 32:
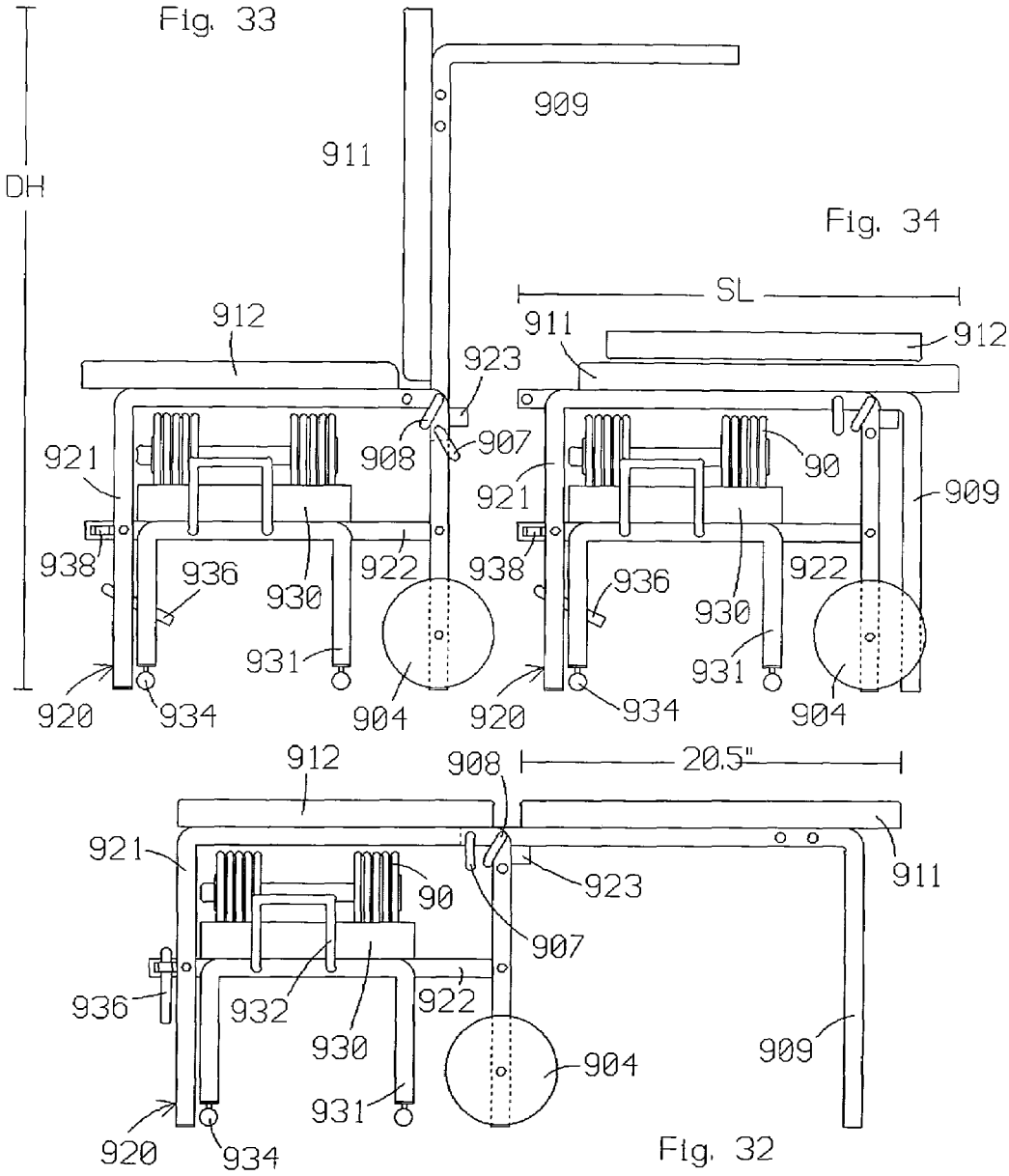
FIG. 32 is a side view of the system of FIGS. 28-31.
Figure 38:
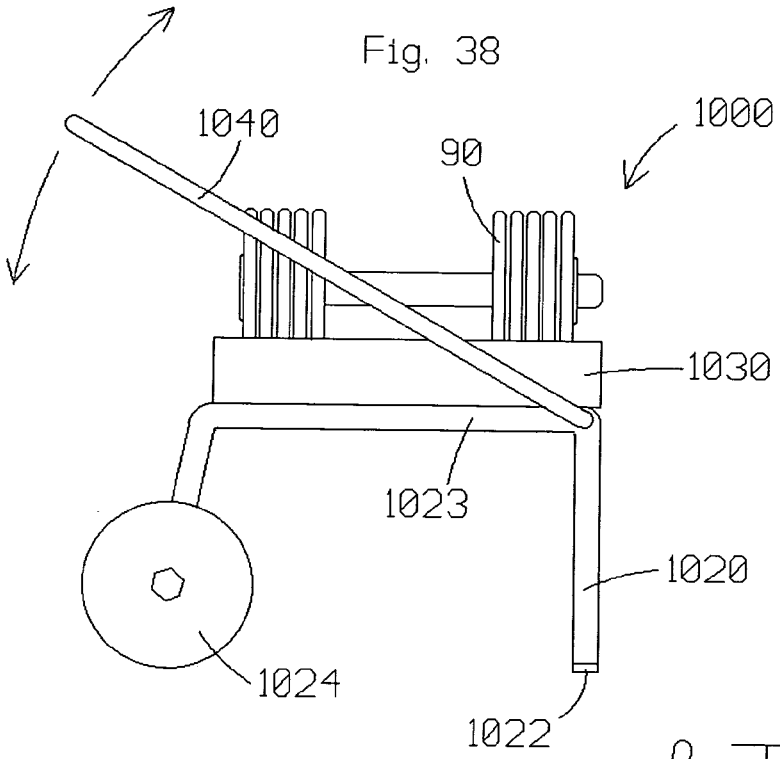
FIG. 38 is a side view of the system of FIG. 36 in a transitional phase between configurations.

The L-shaped members 909 are selectively pivotally connected to the frame 920 between the U-shaped members 921. In particular, the longer distal end of a generally J-shaped rod 908 is inserted through aligned holes in the L-shaped members 909 and the U-shaped members 921 (as shown in FIGS. 32-33). As shown in FIG. 32, the distal end of another generally J-shaped rod 907 is inserted through aligned holes in the L-shaped members 909 and the intermediate segments of respective U-shaped members 921 to lock the system in the "bench configuration" shown in FIG. 32. As shown in FIG. 33, the second J-shaped rod 907 may alternatively be inserted through aligned holes in the L-shaped members 909 and the proximate distal segments of respective U-shaped members 921 to lock the system in the "dolly configuration" shown in FIG. 33. As shown in FIG. 34, the J-shaped rods 907 and 908 may alternatively be used to lock the system in the "compact configuration" shown in FIG. 34.

Each weight support or base 930 is mounted on a respective cart or wing member 931, which may also be described as an inverted U-shaped member. Rollers or casters 934 are mounted on the distal ends of the U-shaped member 931, and the weights supports 930 are mounted on the intermediate portions of respective U-shaped members 931. Handlebars 932 have distal ends portions that are slidably mounted to respective sides of the U-shaped frame member 922; intermediate portions that are rigidly secured to respective U-shaped members 931; and a transversely extending handle portion that is interconnected between the intermediate portions and disposed outboard from a respective weight support 930. The distal ends of the handlebars 932 are preferably configured to resist passage through the associated side of the U-shaped frame member 922. The foregoing arrangement is such that a person may roll the weight supports 930 and associated dumbbell assemblies 90 between respective deployed positions, on opposite sides of the bench member 912 as shown in FIGS. 28-29, and respective stowed positions, beneath the planform of the bench member 912 as shown in FIGS. 30-31. As done in connection with previous embodiments, each of the dumbbell assemblies 90 is shown diagrammatically as the type of dumbbell assembly disclosed in U.S. Pat. No. 5,839,997 to Roth et al., but both the system 900 and the other embodiments of the present invention may be used with various dumbbell assemblies disclosed in the other patents incorporated herein by reference.

A U-shaped locking bar 936 is provided to lock the weight supports 930 in the stowed position shown in FIGS. 30-31. The locking bar 936 is configured for insertion through aligned holes in respective U-shaped members 921 and 931. The holes are aligned to receive and accommodate the locking bar 936 in the inclined orientation shown in FIGS. 33-34. This inclination discourages unintentional withdrawal of the locking bar 936. Clips 938 are provided on opposite sides of the U-shaped frame member 922 to hold the locking bar 936 when not in use (as shown in FIGS. 28-29 and 32).

The system 900 is shown with weight supports 930 that move laterally between deployed and stowed positions, but the present invention is not necessarily limited to such an arrangement. For example, an alternative embodiment may be provided with weight supports that pivot about at least one horizontal axis between respective deployed positions and stowed positions. Another alternative embodiment may be provided with weight supports that pivot about respective vertical axes between respective deployed positions and respective stowed positions.

One such alternative embodiment is designated as 1500 in FIGS. 59-64. The exercise system 1500 may be described in terms of a body supporting platform 1520 mounted on left and right frame members 1511 and 1512; left and right pivoting legs 1551 and 1552 pivotally connected to respective frame members 1511 and 1512; and left and right dumbbell assemblies 1530 supported on respective legs 1551 and 1552.

The body supporting platform 1520 preferably includes a board, a layer of padding material, and a cover secured about the padding material and the board. The padding material and the frame members 1511 and 1512 are disposed on opposite sides of the board. On the embodiment 1500, the second body supporting platform 1426 is approximately 16 inches long (measured parallel to planes defined by respective frame members 1511 and 1512) and approximately 12 inches wide (measured perpendicular to its length).

Each frame member 1511 and 1512 is preferably a cylindrical tube that is configured and arranged into an inverted U-shaped member. The middle portion of each frame member 1511 and 1512 is secured to a respective part of the body supporting platform 1520 by screws. The legs of the frame members 1511 and 1512 are sized to support the body supporting platform 1520 at an elevation of approximately sixteen inches above the floor surface. A transverse support may be interconnected between the rear legs of the frame members 1511 and 1512, by bolts and/or welding, if desired.

Each pivoting leg 1551 and 1552 is preferably a rectangular tube that is configured and arranged into an L-shaped member. A circular hole extends through each leg 1551 and 1552 proximate the distal end of its longer segment. Left and right bushings or sleeves 1515 have a relatively smaller diameter end that is inserted into the hole in a respective leg 1551 or 1552, and a relatively larger diameter end that is rigidly mounted on the front leg of a respective frame member 1511 or 1512 by a bolt or other suitable fastener. Each leg 1551 and 1552 is arranged so that the distal end of its shorter segment rests on the floor. Plastic plugs or feet are preferably secured inside the floor engaging ends of both the legs 1551 and 1552 and the frame members 1511 and 1512. The bushings 1515 are preferably made of plastic to avoid scratching of the frame members 1511 and 1512 during assembly, and to provide a low friction interface for pivoting of the legs 1551 and 1552 relative to respective frame members 1511 and 1512. Upper bushings (not shown) may be rigidly mounted on the frame members 1511 and 1512 prior to installation of the legs 1551 and 1552, in order to prevent upward movement of the latter relative to the former.

Figure 59:
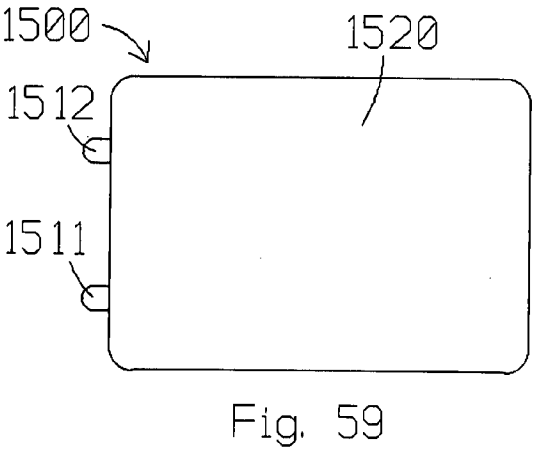
FIG. 59 is a top view of a fourteenth exercise system constructed according to the principles of the present invention, and arranged in a storage configuration.
Figure 61:
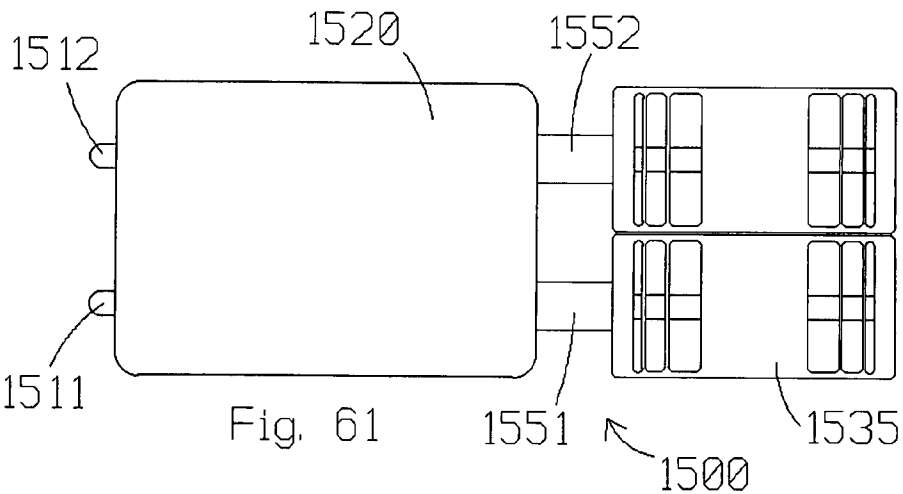
FIG. 61 is a top view of the exercise system of FIG. 59 arranged in a first active configuration.
Figure 60:
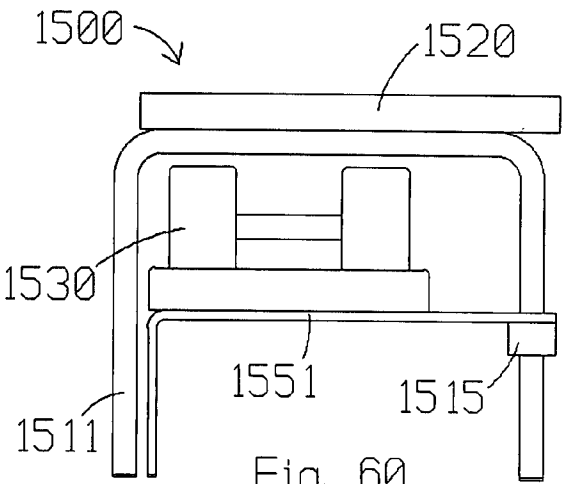
FIG. 60 is a side view of the exercise system of FIG. 59 arranged in the storage configuration.
Figure 62:
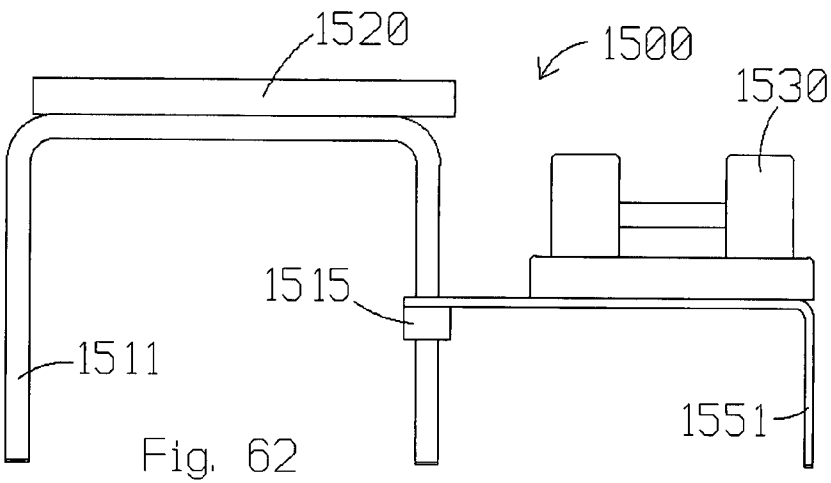
FIG. 62 is a side view of the exercise system of FIG. 61 in the first active configuration.
Figure 63:
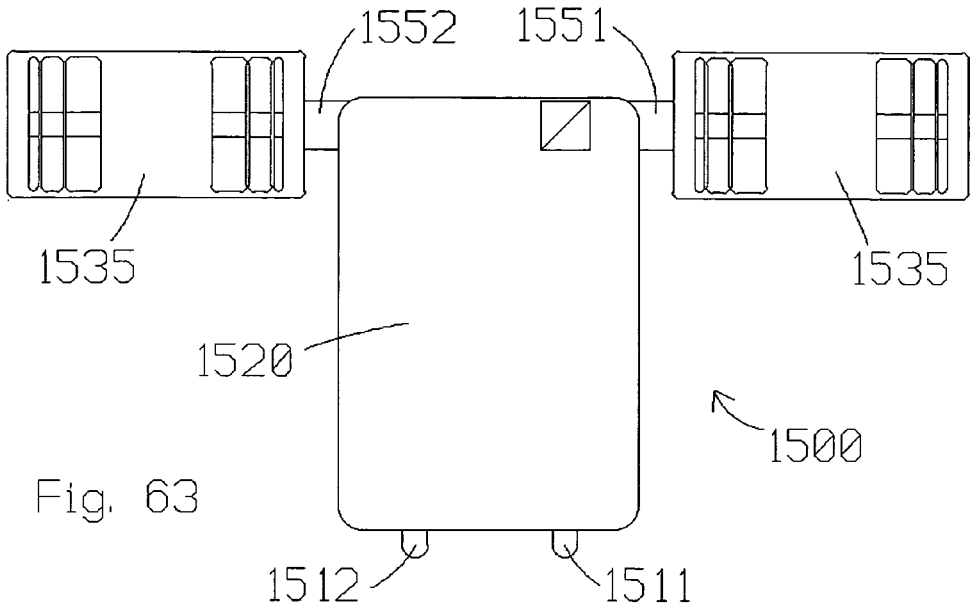
FIG. 63 is a top view of the exercise system of FIG. 59 arranged in a second active configuration.
Figure 64:
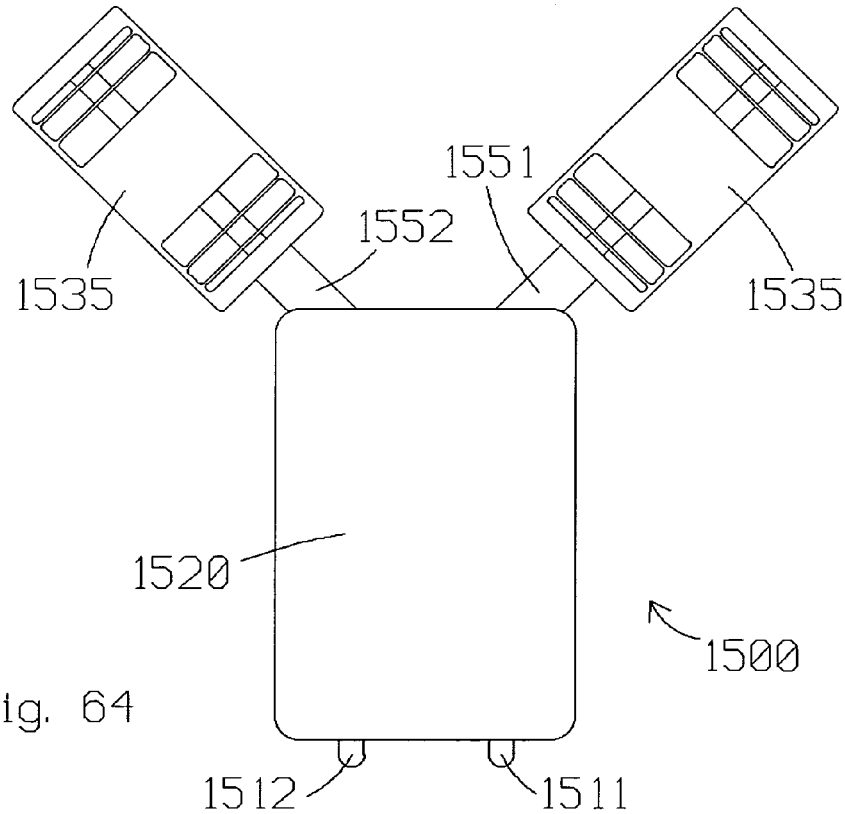
FIG. 64 is a top view of the exercise system of FIG. 59 arranged in a third active configuration.

As on the other embodiments, each weight assembly 1530 includes a base or cradle 1535, as well as a handle and weight plates that are selectively connected to the handle. Each cradle 1535 is mounted on the longer segment of a respective leg 1551 or 1552 by bolts. FIGS. 59-64 show the cradles 1535 in four different positions relative to the body supporting platform 1520. In FIGS. 59-60, the cradles 1535 are disposed directly beneath the body supporting platform 1520. In FIGS. 61-62, the cradles 1535 are pivoted 180 degrees outward from the respective positions shown in FIGS. 59-60. In FIG. 63, the cradles 1535 occupy respective middle positions between those shown in FIGS. 59-60 and 61-62. In FIG. 64, the cradles 1535 occupy respective middle positions between those shown in FIGS. 61-62 and 63.

Figure 65:
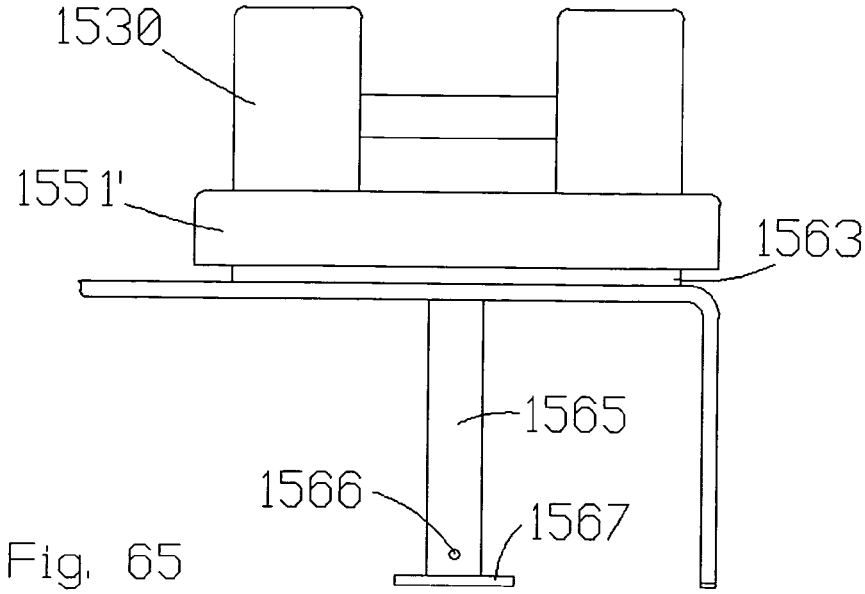
FIG. 65 is a side view of an alternative embodiment dumbbell support suitable for use on the exercise system of FIG. 59, and arranged in a first, relatively low position.
Figure 66:
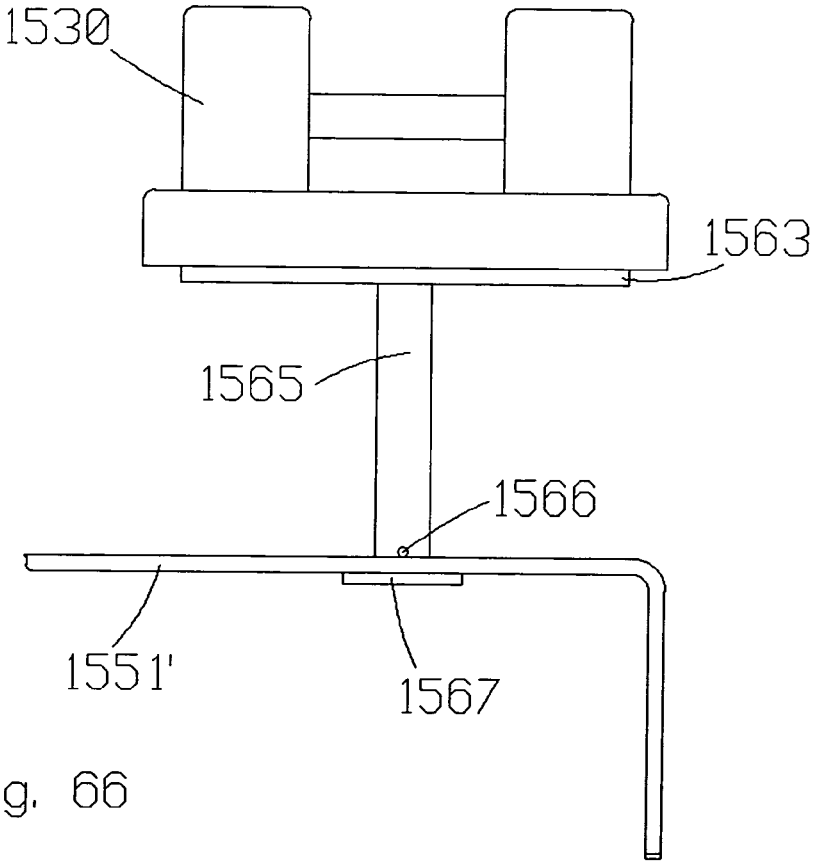
FIG. 66 is a side view of the dumbbell support of FIG. 65 arranged in a second, relatively higher position.

Recognizing that some people may want the weight assemblies 1530 to be supported at a relatively higher elevation than that shown in FIG. 62, accommodations may be made to selectively move the weight assemblies 1530 upward. For example, FIGS. 65-66 show a modified pivoting leg 1551' having a square hole formed through its longer segment, and a square tube 1565 that extends through the hole. The tube 1565 is selectively slidable up and down within the hole, and a bushing may be secured within the hole, if desired, to ensure a smooth interface.

An upper plate 1563 is rigidly secured (by welding) to an upper end of the tube 1565, and the upper plate 1563 is rigidly secured (by bolts) to the cradle of the weight assembly 1530, as well. A lower plate 1567 is rigidly secured (by welding) to a lower end of the tube 1565, and a hole 1566 extends transversely through the tube 1565 proximate the lower plate 1567. This arrangement allows the weight assembly 1530 to be moved between a low elevation position (for storage beneath the body supporting platform 1520), and a high elevation position (for more convenient access from the perspective of a standing person). When the weight assembly 1530 occupies the low elevation position (shown in FIG. 65), the lower plate 1567 rests on the floor surface. When the weight assembly 1530 is moved to the high elevation position (shown in FIG. 66), a pin is inserted through the hole 1566 to hold the tube 1565 in place relative to the leg 1551'.

As suggested by certain preceding embodiments, including the system 1500, those skilled in the art will recognize that various aspects of the present invention may be implemented with various sorts of body supports or body supporting platforms. For example, still another exercise system constructed according to the principles of the present invention is designated as 700 in FIGS. 21-24. The system 700 may be described in terms of a weight container 730 and an aerobic step 750, which are interconnected by a hinge 752 and supported by a frame 721 having wheels 722 on one end thereof.

The support frame 721 has a floor engaging base 726, and floor engaging wheels 722 rotatably mounted on opposite sides of the frame 721. When the base 726 is resting flat upon an underlying floor surface, the system 700 remains stable and stationary. When the system 700 is tilted onto the wheels 722, the system 700 is rollable across the floor surface. Those skilled in the art will recognize that the wheels 722 are not required if a stationary device is preferred. The weight container 730 further includes left and right, upwardly opening weight supports or cradles 732 that are sized and configured to receive and support weight plates 734 and associated dumbbell handles like those mentioned above.

Figure 24:
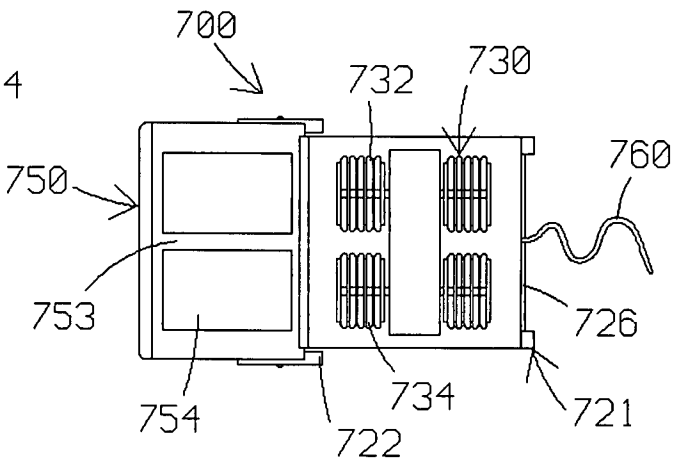
FIG. 24 is a top view of the system of FIG. 23.
Figure 23:
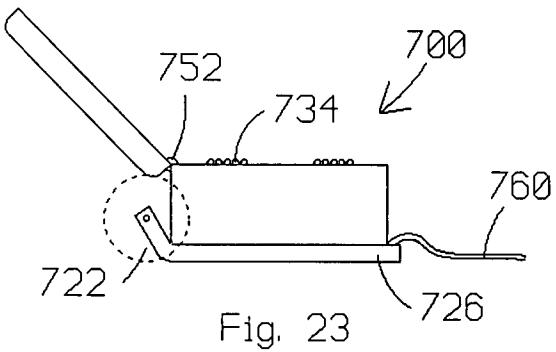
FIG. 23 is a side view of the system of FIG. 21 with the weight container in an exercise configuration on a floor surface.
Figure 22:
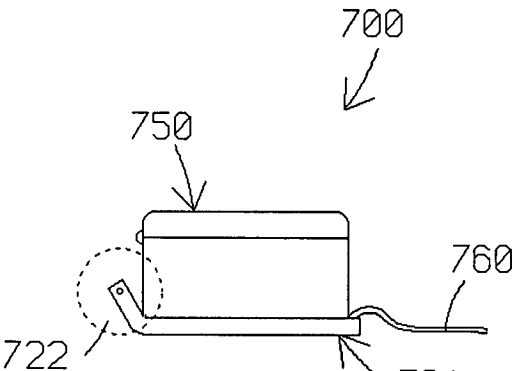
FIG. 22 is a side view of the system of FIG. 21 with the aerobic step in an exercise configuration on a floor surface.

Generally speaking, the step 750 includes a horizontal bearing surface or body supporting platform disposed on top of the weight container 730. Downwardly opening compartments 754 are formed beneath the platform to align with the upwardly opening compartments in the weight container 730 (to accommodate upper portions of the weights 734). A reinforcing beam 753 extends between the two compartments 754 and rests on a middle portion of the weight container 730 when the system 700 is configured as shown in FIG. 22. As shown in FIGS. 23 and 24, the platform is sized and configured to rest against the wheels 722 when opened as far as possible.

Figure 21:
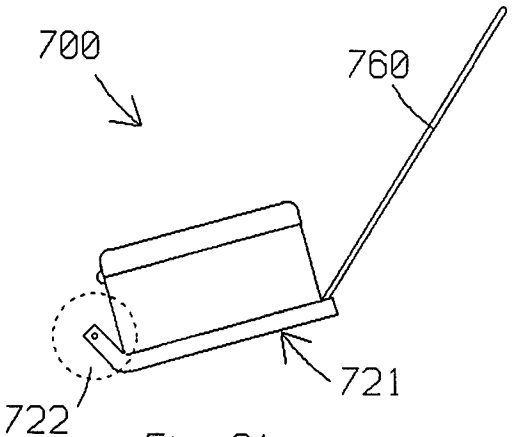
FIG. 21 is a side view of a seventh exercise system constructed according to the principles of the present invention and including a weight container and an aerobic step interconnected in a transport configuration.

The foregoing arrangement 700 may be readily converted from a first configuration, shown in FIGS. 23-24, wherein the weights 734 are available for use, but the step 750 is not immediately available for use; to a second configuration, shown in FIG. 22, wherein the step 750 is available for use, but the weights 734 are not immediately available for use; to a third configuration, shown in FIG. 21, wherein only the wheels 722 are in contact with the floor surface, and neither the weights 734 nor the step 750 is immediately available for use. In this last configuration, a flexible cord 760, which is attached to the frame 721, facilitates maneuvering of the system 700 across a floor surface.

In view of the foregoing system 700 and/or the first embodiment 100, those skilled in the art will recognize additional ways to combine an aerobic step and a weight container in order to practice the present invention. For example, an aerobic step may be sized and configured to straddle a weight container when both are resting upon a floor surface. On another alternative embodiment, the weight container(s) may move like a drawer into and out of the aerobic step.

Another "step" system constructed according to the principles of the present invention is designated as 1400 in FIGS. 53-58. The system 1400 may be described in terms of weight assemblies 1430 and a frame 1410, which are interconnected by a bolt 1413 and a mating nut 1414. As on previous embodiments, each of the weight assemblies 1430 includes a handle; a plurality of weights that are selectively connected to the handle; and a weight support or base that maintains the weights in alignment with the handle.

The frame 1410 includes left and right frame members 1411 and 1412 that may be described in terms of respective C-shaped portions and respective transverse portions. The frame members 1141 and 1412 are arranged so that the C-shaped portions "face" in a common direction, and the transverse portions overlap one another, and are interconnected by bolts 1401 and mating nuts.

A first body supporting platform 1425 is secured to the "open" side of each C-shaped portion by screws 1404 and 1405. The first body supporting platform 1425 preferably includes a board, a layer of padding material, and a cover secured about the padding material and the board. The padding material and the frame members 1411 and 1412 are disposed on opposite sides of the board. On the embodiment 1400, the first body supporting platform 1425 is approximately 15 inches long (measured perpendicular to the transverse portions) and approximately 13.5 inches wide (measured perpendicular to its length).

A second body supporting platform 1426 is secured to an adjacent, relatively shorter side of each C-shaped portion by screws 1406. The second body supporting platform 1426 lies flush across the C-shaped portions and an end of the first body supporting platform 1425. The second body supporting platform 1426 preferably includes a board, a layer of padding material, and a cover secured about the padding material and the board. Again, the padding material and the frame members 1411 and 1412 are disposed on opposite sides of the board. On the embodiment 1400, the second body supporting platform 1426 is approximately 13.5 inches long (measured parallel to the width of the first body supporting platform 1425) and approximately 8 inches wide (measured perpendicular to its length).

The frame 1410 also includes a transverse member 1416 that extends between the frame members 1411 and 1412 proximate an opposite end of the first body supporting platform 1425. The transverse member 1416 is secured to support brackets 1415 by bolts, rivets, or other means known in the art. The support brackets are also secured to the frame members 1411 and 1412 by means of the screws 1405 described above. Those skilled in the art will recognize that the transverse member 1416 may also be secured in place by welding.

The bolt 1413 extends through a corner of each C-shaped portion, diagonally opposite the juncture between the two body supporting platforms 1425 and 1426. The bolt 1413 also extends through an end of each weight cradle. The bolt 1423 defines a horizontal pivot axis between the weight cradles and the frame 1410. FIGS. 53-58 show the system 1400 with the frame 1410 in three different orientations relative to the floor surface, while the dumbbell assemblies 1430 occupy the same, upright orientation in each instance.

Figure 53:
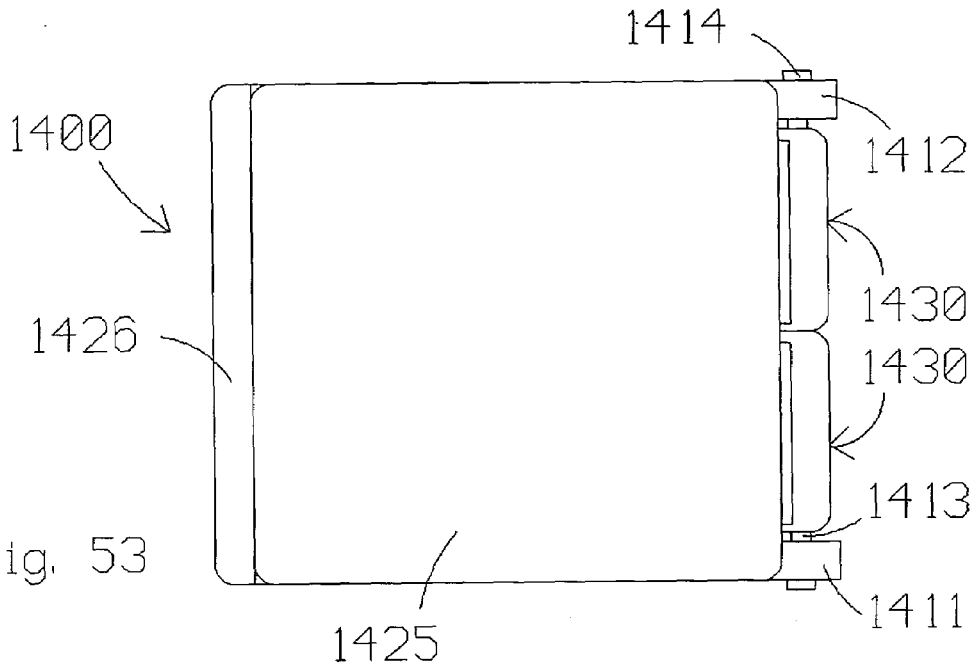
FIG. 53 is a top view of a thirteenth exercise system constructed according to the principles of the present invention, and arranged in a storage configuration.
Figure 54:
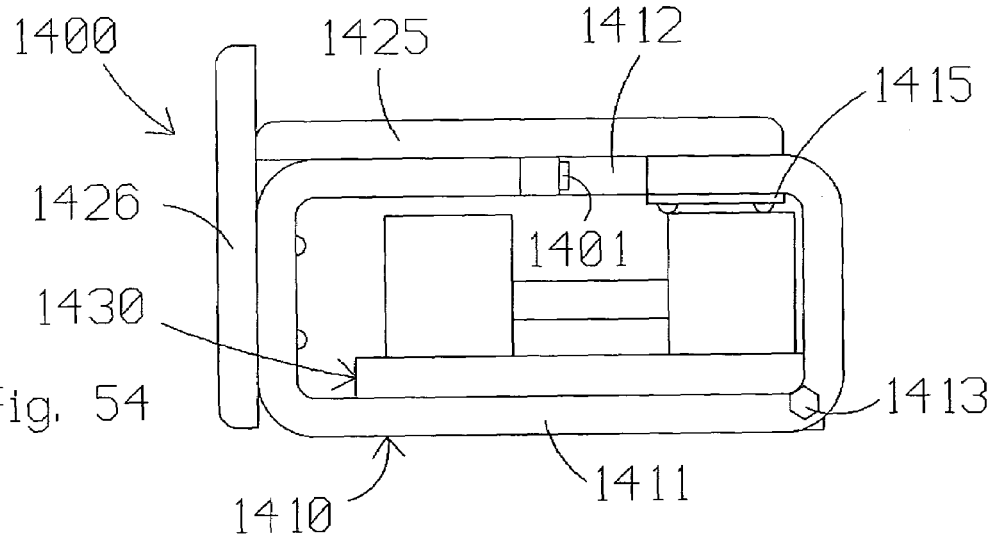
FIG. 54 is a side view of the exercise system of FIG. 53.

FIGS. 53-54 show the system 1400 in a first configuration, wherein the first body supporting platform 1425 extends parallel to the floor surface, and overlies the weight assemblies 1430. Recognizing that a small portion of the weight assemblies 1430 remains visible from above, the term "overlies" or related descriptions should be interpreted with a certain amount of latitude to include situations where at least eighty-five percent of the weight assemblies are covered or hidden from above. In any event, FIGS. 53-54 show the system 1400 arranged for storage, use as a foot stool, and/or use as an aerobic step (with the body supporting platform 1425 is disposed approximately eight inches above the floor surface).

Figure 55:
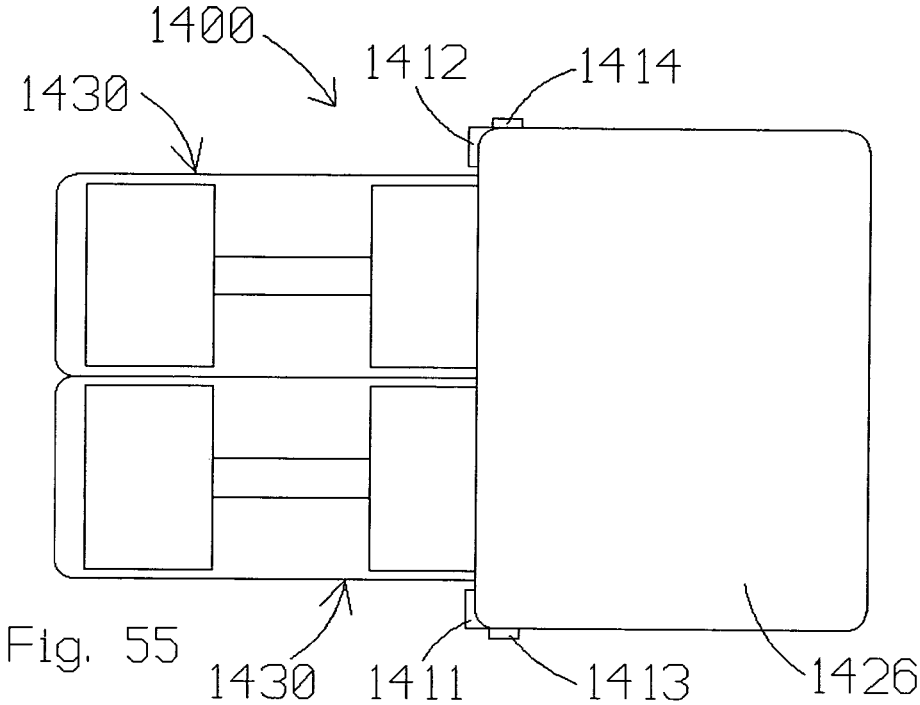
FIG. 55 is a top view of the exercise system of FIG. 53 arranged in a first active configuration.
Figure 56:
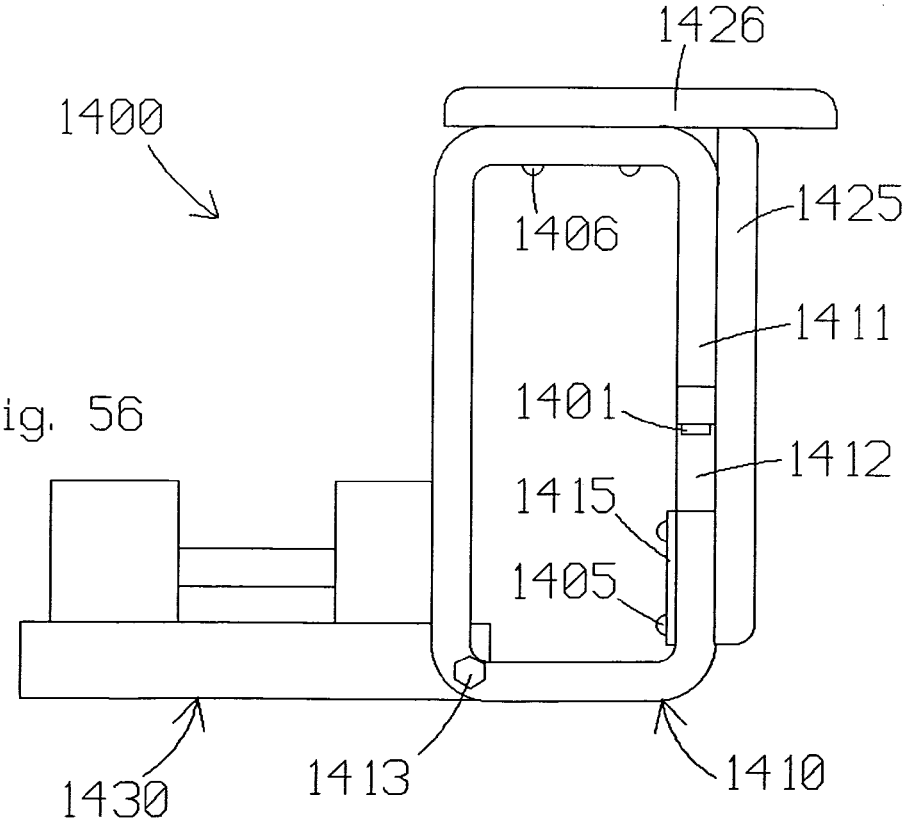
FIG. 56 is a side view of the exercise system of FIG. 55 in the first active configuration.

FIGS. 55-56 show the system 1400 in a second configuration, wherein the second body supporting platform 1426 extends parallel to the floor surface, and the weight assemblies 1430 are resting uncovered on the floor surface (at least eighty-five percent uncovered). In this configuration, the system 1400 is arranged for use as a seat or a high step platform (with the body supporting platform 1426 disposed approximately sixteen inches above the floor surface), and the dumbbell assemblies 1430 are deployed for use.

Figure 58:
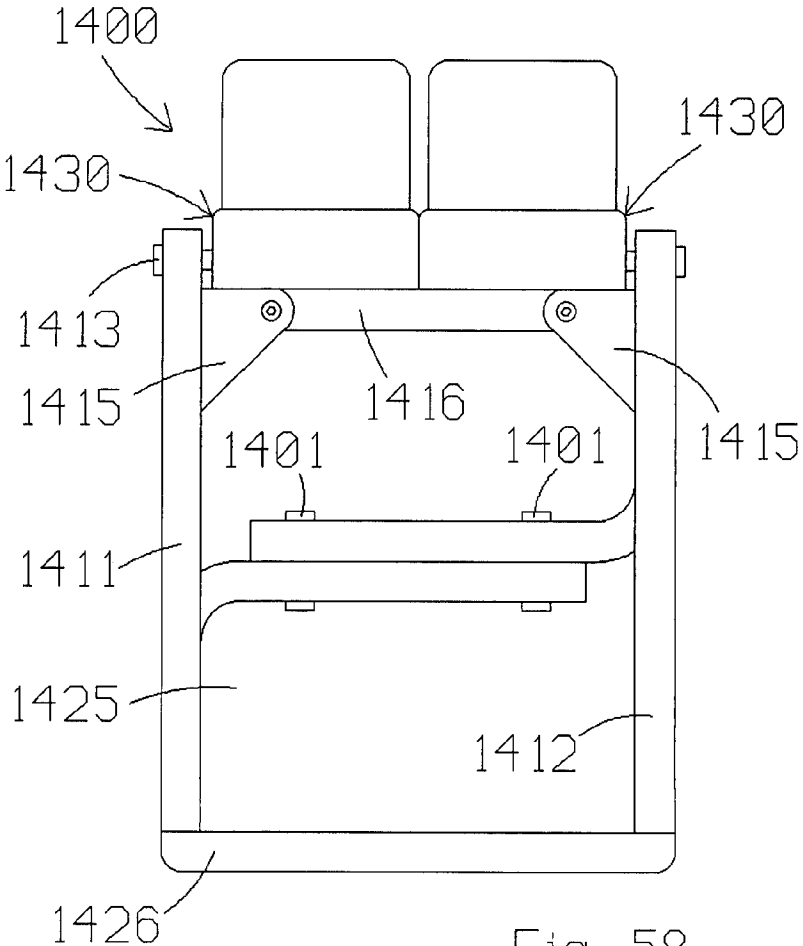
FIG. 58 is a front view of the exercise system of FIG. 57 in the second active configuration.
Figure 57:
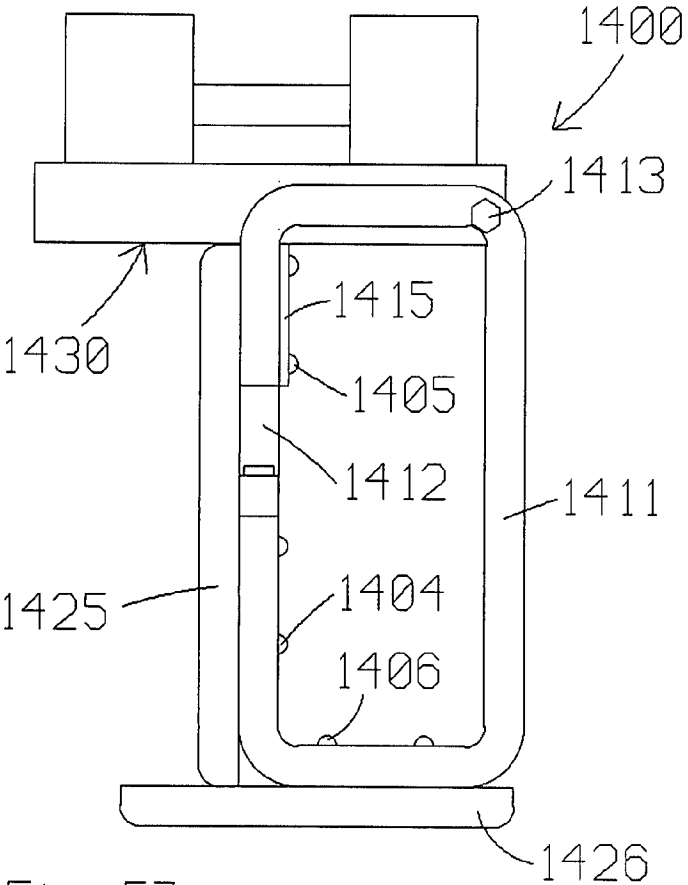
FIG. 57 is a side view of the exercise system of FIG. 53 arranged in a second active configuration.

FIGS. 57-58 show the system 1400 in a third configuration, wherein the second body supporting platform 1426 is resting flush on the floor surface, and the weight assemblies 1430 are supported approximately fourteen inches above the floor surface. In this configuration, the system 1400 is arranged for use as a dumbbell stand, and the dumbbell assemblies 1430 are more readily accessible for use.

Those skilled in the art will recognize that the present invention is not limited to weight supporting structures that include a body supporting element. In this regard, FIGS. 35-39 show a dumbbell system 1000 that simply includes a stand and a dumbbell assembly 90 supported on the stand. The stand includes a frame member 1020 that may be described as an inverted U-shaped tube having a rectangular cross-section. A plastic end cap 1022 is inserted into one end of the frame member 1020, and left and right wheels 1024 are rotatably mounted on opposite sides of an opposite end of the frame member 1020. The wheels 1024 and the end cap 1022 cooperate to maintain an intermediate portion 1023 of the frame member 1020 in a stable and horizontal orientation.

A weight support or base 1030 is mounted on top of the intermediate portion 1023 of the frame member 1022. The weight support 1030 is configured to support and accommodate operation of an adjustable dumbbell assembly (depicted as another dumbbell assembly 90). When configured as shown in FIGS. 35-37, the system 1000 has a length LT of seventeen inches, a width WT of seven and one-half inches, and a height HT of fourteen inches.

Figure 39:
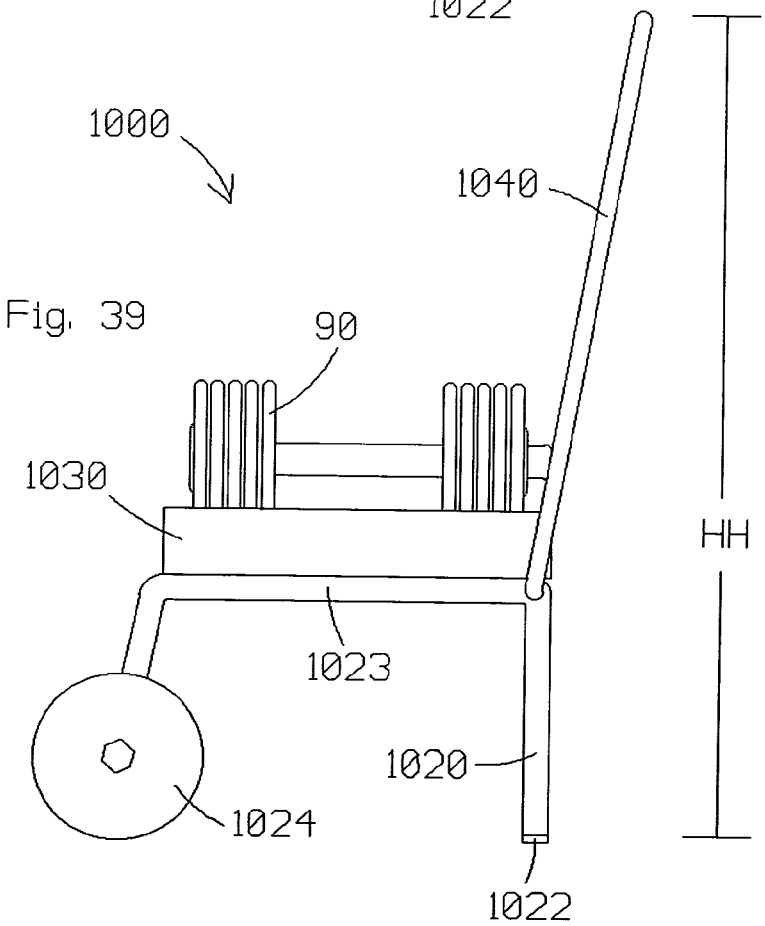
FIG. 39 is a side view of the system of FIG. 36 configured for transport.

A U-shaped handlebar 1040 has opposite ends rotatably connected to the frame member 1020 proximate the juncture of the intermediate portion 1023 and the end portion associated with the end cap 1022. An opposite, intermediate portion 1044 of the handlebar 1040 is sized and configured for grasping. As suggested by the arrows in FIG. 38, the handlebar 1040 is rotatable between a rest position shown in FIG. 35 and an active position shown in FIG. 39. When the system 1000 is configured as shown in FIG. 39, the height HH of the handle 1044 relative to the floor or ground is twenty-five inches.

The system 1000 may be considered advantageous to the extent that it is relatively simple in construction, consumes relatively little space, and facilitates relocation within a room. Also, it is sized to position the dumbbell assembly 90 at a convenient height relative to a weight bench. On the other hand, an alternative embodiment stand may be made to place the dumbbell assembly 90 at a convenient height for a standing person (or to adjust between multiple heights). Furthermore, two of the systems 1000 may be used to position respective dumbbell assemblies 90 in any desired relation to one another. For example, the two dedicated systems 1000 may be positioned on opposite sides of a bench, or with sufficient space therebetween to accommodate a standing person with his shoulders directed toward respective dumbbell assemblies 90. Such an arrangement reduces the likelihood of injury by allowing the person to lift the dumbbells without leaning forward.

Figure 44:
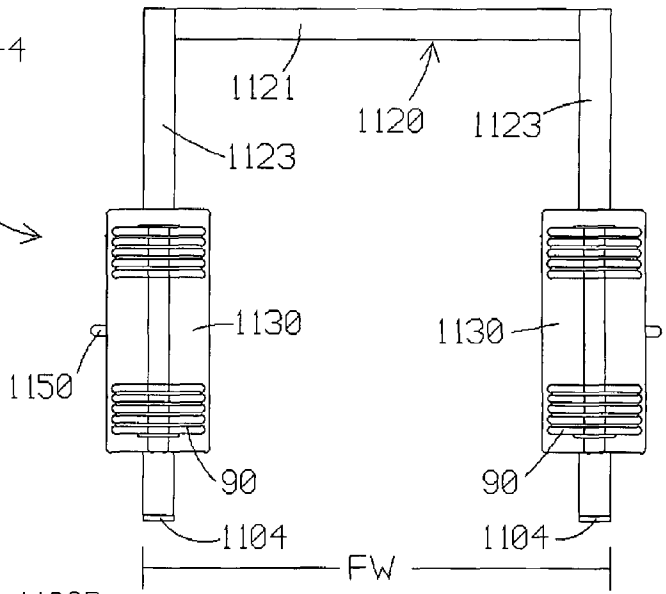
FIG. 44 is a top view of the system shown in FIG. 43 and configured in similar fashion.
Figure 43:
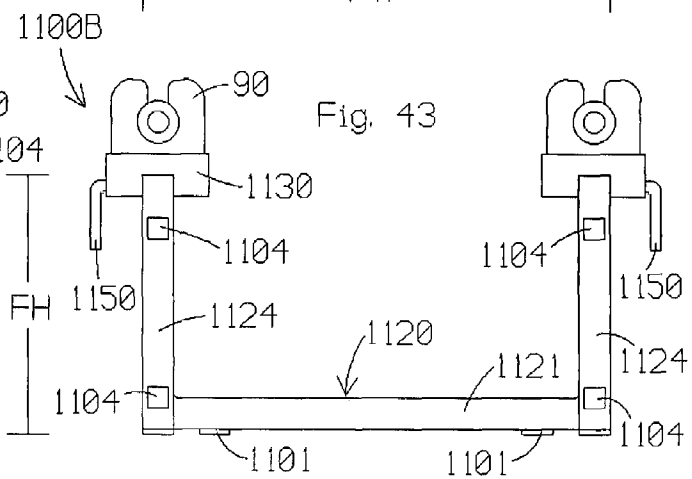
FIG. 43 is a front view of the system of FIG. 40 reconfigured to accommodate a seated user.
Figure 45:
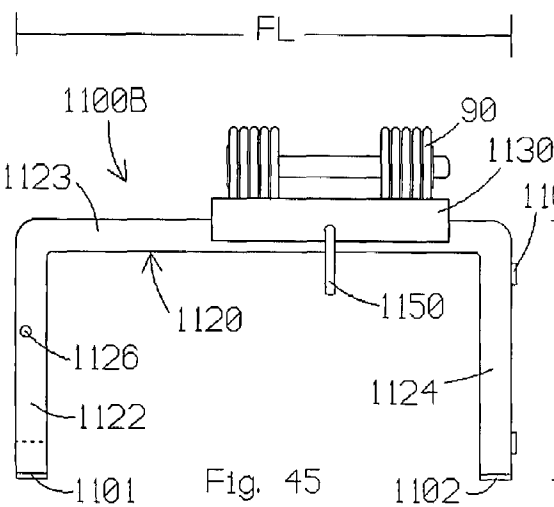
FIG. 45 is a side view of the system shown in FIG. 43 and configured in similar fashion.

Another "stand" system is designated as 1100A in FIGS. 40-42, and as 1100B in FIGS. 43-45. The system (of which 1100A and 1100B are simply different arrangements) similarly includes a stand and dumbbell assemblies 90 supported on the stand. The stand includes a frame member 1120 that may be described as a single piece of steel tube that has been bent into a desired configuration. The frame member 1120 includes a central transverse member 1121, left and right short intermediate members 1122, left and right long intermediate members 1123, and right and left end members 1124. The length FL of the frame member 1120 (shown in FIG. 45) is twenty-four inches; the width FW of the frame member 1120 (shown in FIG. 44) is twenty-two and one-half inches; and the height FH of the frame member 1120 (shown in FIG. 45) is twelve inches.

Bearing plates 1101 are preferably mounted on the central transverse member 1121, and similar bearing plates 1104 are preferably mounted on respective end members 1124. Also, end caps 1102 are inserted into the distal ends of respective end members 1124. The bearing plates 1101 and 1104 and the end caps 1102 are provided to reduce potential damage to an underlying floor surface, and are preferably made of plastic or rubber. Among other things, the bearing plates 1101 and 1104 and the end caps 1102 may be replaced by casters, if desired.

FIGS. 43-45 show the system 1000B with the stand arranged in a relatively high profile orientation, with the plates 1101 and the end caps 1102 resting on an underlying floor surface. In this orientation, the height of the stand is twelve inches (designated as FH in FIG. 45), thereby positioning the dumbbell assemblies 90 to accommodate a seated person.

Each weight support 1130 is mounted on a respective long intermediate member 1123. In this regard, each weight support 1130 is provided with a downwardly opening channel to straddle a respective frame member 1123. L-shaped detent pins 1150 are then inserted through aligned holes in respective weight supports 1130 and respective frame members 1123. One of the respective frame member holes 1125 is shown in FIG. 42.

FIGS. 40-42 show the system 1100A with the stand arranged "on end" or in a relatively high profile orientation, with the plates 1104 resting on the floor surface. In this orientation, the height of the stand is twenty-four inches (designated as FL in FIGS. 42 and 45), thereby positioning the dumbbell assemblies 90 to accommodate a standing person.

Each weight support 1130 is mounted on a respective short intermediate member 1122. As noted above, each weight support 1130 is provided with a downwardly opening channel to straddle a respective frame member 1122. The L-shaped detent pins 1150 are inserted through aligned holes in respective weight supports 1130 and respective frame members 1122. One of the respective frame member holes 1126 is shown in FIG. 45.

In either configuration 1100A or 1100B, the transversely measured distance between the weight supports 1130 (designated as DW in FIG. 40) is sixteen inches. As a result, when the system is configured as shown in FIGS. 40-42, a person can walk into the gap between the dumbbell assemblies 90 and lift and return the dumbbells while maintaining a desired posture. Also, when the system is configured as shown in FIGS. 43-45, a person can sit between the dumbbell assemblies 90 (on a bench disposed therebetween, for example), and remove and return the dumbbells while maintaining a desired posture.

Figure 47:
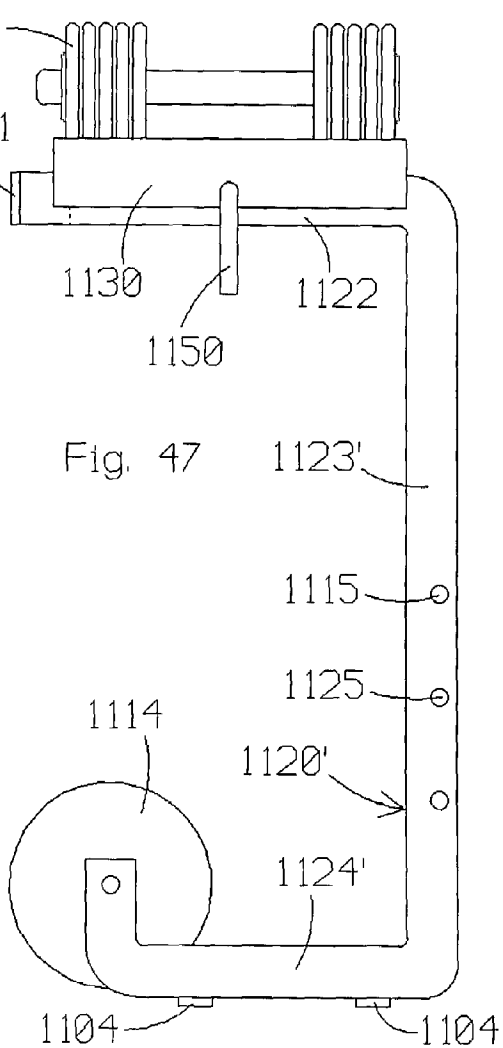
FIG. 47 is a side view of the modified system of FIG. 46 reconfigured to accommodate a standing user.
Figure 46:
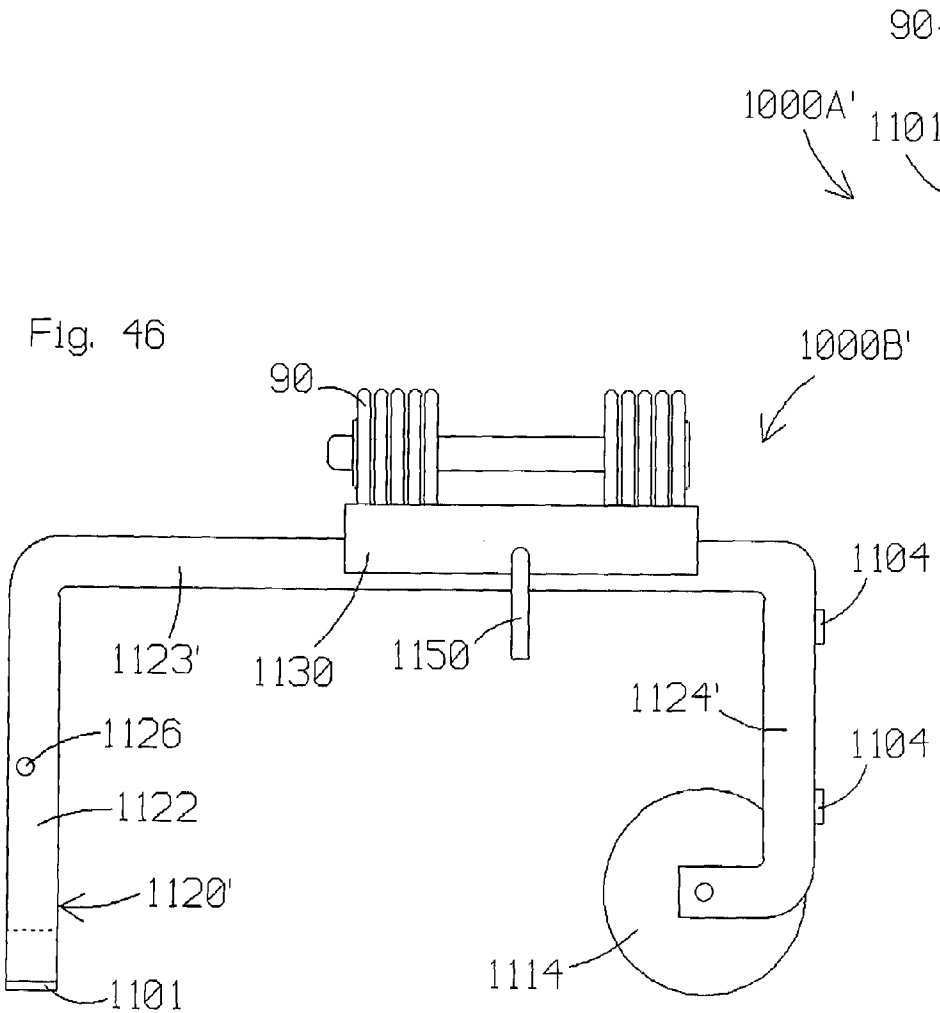
FIG. 46 is a side view of the system of FIGS. 40-45 configured to accommodate a seated user, and shown in a modified form with one of its optional wheels removed.
Figure 48:
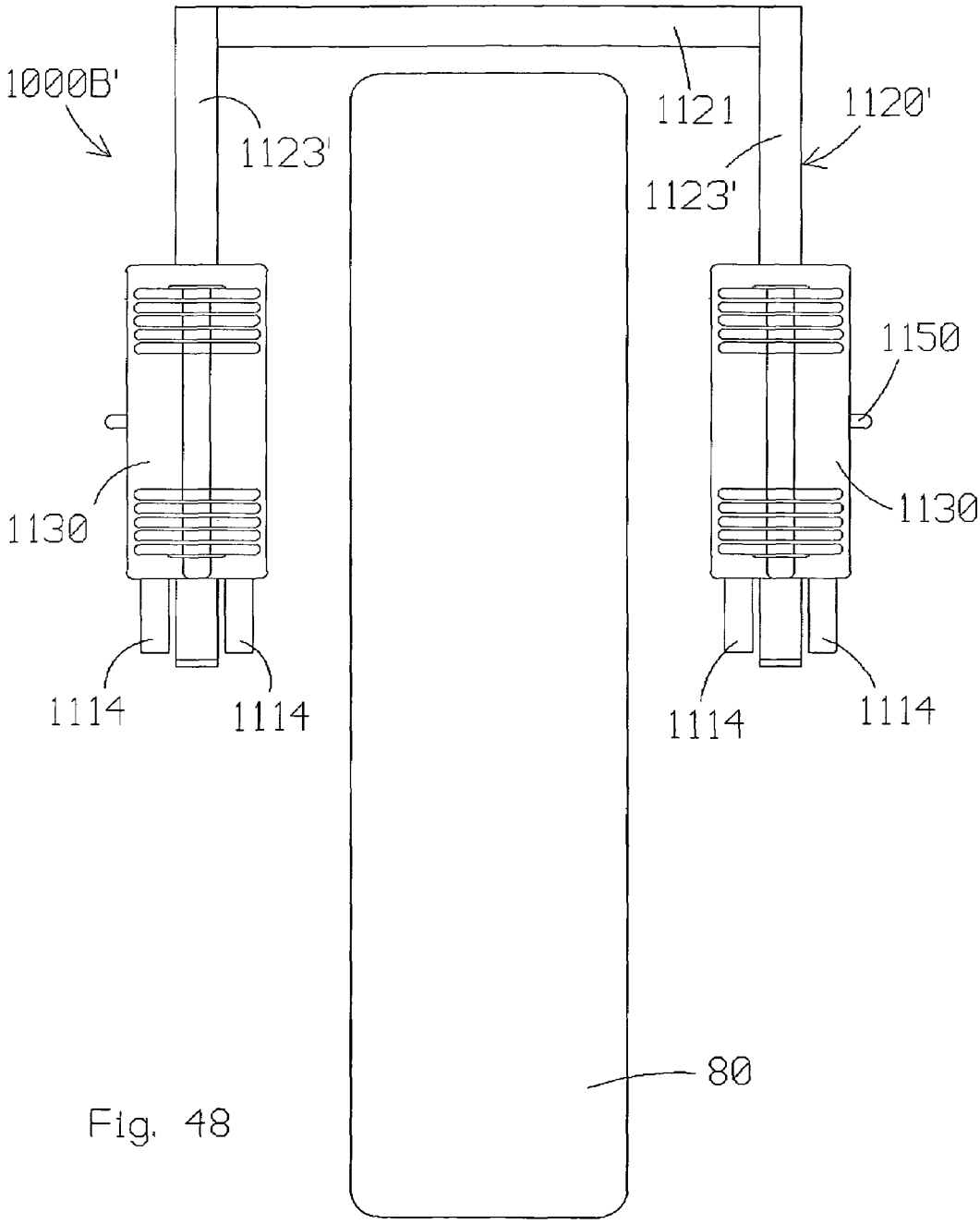
FIG. 48 is a top view of the modified system of FIG. 46 with an optional bench shown therewith.

FIGS. 46 and 48 show a modified arrangement 1100B', and FIG. 47 shows a modified arrangement 1100A'. As suggested by the common reference numerals, these arrangements 1100A' and 1100B' are similar to the arrangements 1100A and 1000B except with respect to the frame 1120' and associated wheels 1114. In this regard, the frame 1120' has end segments 1124' that are L-shaped, and pairs of wheels 1114 that are rotatably on opposite sides of respective end segments 1124'. These modifications make the arrangements 1100A' and 1100B' relatively more mobile than their counterparts 1100A and 1100B. FIG. 47 also shows additional holes 1115 in the long intermediate members 1123' to accommodate adjustment of the weight supports 1130 relative thereto. FIG. 48 also shows how a conventional bench 80 may be positioned relative to the arrangement 1100B' (or the arrangement 1000B in the alternative), thereby placing the weight supports 1130 within reach of a person seated on the bench 80.

FIGS. 49-52 show still another "stand" embodiment 1200 of the present invention. This dumbbell system 1200 includes a base 1220, left and right adjustment members 1210 adjustably mounted on the base 1220, left and right weight supports 1230 mounted on respective adjustment members 1210, and left and right dumbbell assemblies 90 supported by respective weight supports 1230.

The base 1220 may be described as a single piece of steel tube that has been bent into a desired configuration, including a central transverse member 1221, left and right intermediate members 1222, and right and left end members 1223. A hole extends through the upper distal end of each end member 1223 to receive a respective detent pin 1250. Also, bearing plates 1101 are mounted on the downwardly facing sides of the central transverse member 1221 and the left and right intermediate members 1222.

Each adjustment member 1210 may be described as single piece of steel tube that has been bent into an L-shaped configuration. The adjustment members 1210 are sized and configured for insertion into the upper ends of respective end members 1223. Also, several holes 1215 extend through the vertically extending portion of each adjustment member 1210 to alternatively receive a respective detent pin 1250. In other words, each adjustment member 1210 telescopes within a respective end member 1223 and is selectively locked in place by inserting the detent pin 1250 through the hole in the end member 1223 and an aligned hole in the adjustment member 1210. As a result, the overall height of the stand is variable between a maximum H1 of twenty-three inches and a minimum H2 of fourteen inches.

Each weight support 1230 is mounted on the horizontally extending portion of a respective adjustment member 1210 in the same manner as the weight supports 1130 are mounted on the frame members 1122 on the previous embodiments 1100A and 1100B. The adjustability of the stand height accommodates a range of user heights and applications.

Those skilled in the art will recognize that the present invention is not limited to the embodiments described above and/or depicted in the accompanying drawings. Furthermore, it is understood that various features may be implemented and/or combined in various ways as a matter of design choice. Moreover, the present invention is not limited to any one embodiment and in fact, may be expressed in various terms which are broad enough to cover a variety of embodiments and/or applications.

Those skilled in the art will also recognize that the present invention may be described and/or claimed in terms of various methods with reference to the foregoing embodiments. Such methods may include methods of using selectorized dumbbells, methods of storing selectorized dumbbells, and/or methods of transporting selectorized dumbbells. Such methods may also include methods of exercise with selectorized dumbbells.

The foregoing description and accompanying drawings will enable persons skilled in the art to make and use the present invention in various forms. In construing the nature and scope of the present invention, no special significance should attach to the fact that some of the features and/or advantages are discussed and/or shown in greater detail than others. For example, the wheels provide a necessary function on certain embodiments, but they are often shown in phantom lines to facilitate the depiction of other elements and/or to emphasize that the wheels could be omitted on alternative embodiments. Also, some terms are used with the understanding that they will be interpreted in common sense fashion so as to afford appropriate scope to the subject invention. For example, geometric terms such as horizontal and vertical should be construed in a relatively broad sense to include orientations within thirty degrees of same. With the foregoing in mind, the scope of the present invention should be limited only to the extent of the following claims.

What is claimed is:

1. An exercise system, comprising:

a frame adapted to rest on a floor surface;

a body supporting platform mounted on the frame; and a first dumbbell assembly and a second dumbbell assembly, wherein each said dumbbell assembly includes a handle that defines a longitudinal axis, a set of weights configured for connection to a respective said handle, and a base that is sized and configured to support a respective said set of weights in alignment with a respective said handle, wherein each said base is pivotally connected to the frame for pivoting about a horizontal pivot axis from a respective first position underlying the body supporting platform to a respective second position out from under the body supporting platform.

2. The exercise system of claim 1, wherein each said base is adapted to rest on the floor surface in at least one said position.

3. The exercise system of claim 1, further comprising a second body supporting platform mounted on the frame and arranged to extend perpendicular to the first body supporting platform, wherein each said body supporting platform underlies each said base when each said base occupies said respective second position.

4. The exercise apparatus of claim 1, further comprising a second body supporting platform mounted on the frame, wherein at least part of each said base underlies the second body supporting platform when each said base occupies said respective second position.

5. The exercise apparatus of claim 1, wherein each said handle extends perpendicular to the horizontal pivot axis in each said position.

6. An exercise system, comprising:

a frame adapted to rest on a floor surface;

a body supporting platform mounted on the frame; and a first dumbbell assembly and a second dumbbell assembly, wherein each said dumbbell assembly includes a handle that defines a longitudinal axis, a set of weights configured for connection to a respective said handle, and a base that is both adapted to rest on the floor surface and sized and configured to support a respective said set of weights in alignment with a respective said handle, wherein each said base is movably connected to the frame for movement between a respective first position underlying the body supporting platform, and a respective second position out from under the body supporting platform, and in at least one said position, each said base has a lowermost portion that is co-planar with lowermost portions of the frame.

7. The exercise system of claim 6, wherein when occupying said respective first position, each said lowermost portion is co-planar with lowermost portions of the frame, and when occupying said respective second position, each said lowermost portion is spaced apart from a plane defined by lowermost portions of the frame.

8. The exercise system of claim 6, further comprising a second body supporting platform mounted on the frame and arranged to extend perpendicular to the first body supporting platform both when each said base occupies said respective first position and when each said base occupies said respective second position.

9. The exercise apparatus of claim 6, wherein each said base pivots about a common axis relative to the frame.

10. The exercise apparatus of claim 6, wherein the handle of the first dumbbell assembly extends parallel to the handle of the second dumbbell assembly both when each said base occupies said respective first position and when each said base occupies said respective second position.

11. An exercise system, comprising:

a frame adapted to rest on a horizontal floor surface; and a first dumbbell assembly and a second dumbbell assembly, wherein each said dumbbell assembly includes a handle that defines a longitudinal axis, a set of weights configured for connection to a respective said handle, and a base that is both adapted to rest on the floor surface and sized and configured to support a respective said set of weights in alignment with a respective said handle, wherein each said base is movably connected to the frame for movement between a respective first position, wherein the frame supports each said base at an elevation above a plane defined by lowermost portions of the frame, and a respective second position, wherein a lowermost portion of each said base is co-planar with the lowermost portions of the frame.

12. The exercise system of claim 11, wherein each said base is upright relative to the plane in the respective first position, and each said base is upright relative to the plane in the respective second position.

13. The exercise system of claim 11, further comprising a body supporting platform mounted on the frame and defining a planform, wherein each said base is disposed outside the planform when occupying the respective second position.

14. The exercise apparatus of claim 13, wherein each said base is disposed within the planform when occupying the respective first position.

15. The exercise apparatus of claim 11, further comprising a body supporting platform mounted on the frame and defining a planform, wherein each said base is disposed within the planform when occupying the respective first position.

* * * * *